US005359305A

United States Patent [19]

Kitamura et al.

[11] Patent Number: 5,359,305

[45] Date of Patent: Oct. 25, 1994

[54] ELECTROMAGNETIC RELAY

[75] Inventors: Nobuhiro Kitamura; Naoki Kanemoto; Yoichi Yokoyama; Kiwamu Shibata; Tetsuyasu Kawamoto; Masahiro Kutsuna, all of Kadoma, Japan

[73] Assignee: Matsushita Electric Works, Ltd., Osaka, Japan

[21] Appl. No.: 73,369

[22] Filed: Jun. 7, 1993

[30] Foreign Application Priority Data

| | | | |
|---|---|---|---|
| Jun. 15, 1992 | [JP] | Japan | 4-155211 |
| Jul. 8, 1992 | [JP] | Japan | 4-181352 |
| Jul. 29, 1992 | [JP] | Japan | 4-202595 |
| Jul. 29, 1992 | [JP] | Japan | 4-202596 |
| Jan. 29, 1993 | [JP] | Japan | 5-014278 |

[51] Int. Cl.[5] ..... H01H 51/22

[52] U.S. Cl. ..... 335/78; 335/83; 335/129

[58] Field of Search ..... 335/78-86, 335/124, 128, 131, 129

[56] References Cited

U.S. PATENT DOCUMENTS 4,625,191 11/1986 Oberndorfer et al. ..... 335/125

FOREIGN PATENT DOCUMENTS

| | | |
|---|---|---|
| 55-42341 | 10/1955 | Japan . |
| 51-23863 | 6/1976 | Japan . |
| 61-233919 | 10/1986 | Japan . |
| 62-71137 | 4/1987 | Japan . |
| 62-71138 | 4/1987 | Japan . |

*Primary Examiner*—Lincoln Donovan
*Attorney, Agent, or Firm*—Kenyon & Kenyon

[57] ABSTRACT

An electromagnetic relay includes a pair of contacts of high fusion-bonding resistance and a further pair of contacts of low contact resistance, which pairs being connected mutually in parallel relationship, with an actuator of an electromagnet unit interposed between them and respectively having a movable contactor carrying a movable contact of the pair and provided for contact opening and closing with respect to a stationary contact of the pair by means of the actuator of the electromagnet unit, whereby the pair of contacts of low contact resistance can be prevented from causing any fusion-bonding and any temperature rise around the pair can be effectively restrained.

9 Claims, 23 Drawing Sheets

ELECTROMAGNETIC RELAY

BACKGROUND OF THE INVENTION

This invention relates to electromagnetic relays and, more particularly, to an electromagnetic relay having a contact opening and closing means for energizing and deenergizing a load of a large rush current or which is for use in conjunction with a remote controlling device.

The electromagnetic relay of the kind referred to finds its utility when utilized in ON/OFF control of luminair or the like.

DESCRIPTION OF RELATED ART

Generally the contact opening and closing means incorporated in the electromagnetic relay is so provided that a movable contactor carrying a movable contact made engageable with and disengageable from a stationary contact is driven by an electromagnet device for opening and closing the contacts. In this connection, there arises a risk that, in an event where a capacitor load or a lamp load is to be energized or deenergized, a large rush current is caused to flow and the contacts are caused to be fused to bond each other or welded to each other by an arc generated by such rush current. While there has been suggested a measure for preventing this risk by employing such contactor material as tungsten which is excellent in the fusion-bonding resistance, the particular material is so high in the resistance value that there arises another problem of a temperature rise in contact closing state, that is, even during a rated current supply.

In respect of the above, there have been suggested various measures for simultaneously attaining mutually opposite two actions of the fusion-bonding resistance and the low contact resistance with such arrangement that both of a pair of contact excellent in the fusion-bonding resistance and a further pair of contacts excellent in the contact resistance are concurrently provided as connected in mutually parallel relationship for allowing contactors carrying respectively a movable contact in each pair to be driven by the electromagnet device having a contact opening and closing means so that, upon the contact closing operation, the contact pair excellent in the fusion-bonding resistance will be first closed prior to the further contact pair excellent in the contact resistance and, upon the contact opening operation, the contact pair excellent in the fusion-bonding resistance will be opened after the opening of the further contact pair excellent in the contact resistance. Prior art references of the kind referred to will be Japanese Utility Model Publication Nos. 51-23863 and 55-42341 and Japanese Patent Laid-Open Publication Nos. 61-233919, 62-71137, 62-71138 and so on.

In the contact opening and closing means incorporated in the foregoing relay, however, the contact pair high in the fusion-bonding resistance and the further contact pair low in the contact resistance are disposed in close relationship to each other, and there has been a problem that, when the contact pair high in the fusion-bonding resistance are closed first upon the closing operation with respect to the capacitor load or the like in particular, an arc heat generated due to bouncing motion of the contacts upon flowing of the large rush current through the contact pair high in the fusion-bonding resistance will be given to the contact pair low in the contact resistance, or a deposition of fused particles of the contact material of the contact pair high in the fusion-bonding resistance onto the further contact pair low in the contact resistance due to the arc generation at the contact pair high in the fusion-bonding resistance, whereby the temperature around the contact pairs will be still caused to rise.

Further, since both of the contact pair high in the fusion-bonding resistance and the further contact pair low in the contact resistance are of a flexure contactor type, there have been further problems that the operational efficiency of the electromagnetic means may happen to be decreased when these contact pairs are actuated by a bistable electromagnet means, and a time interval from the actuation of the contact pair high in the fusion-bonding resistance to the actuation of the contact pair of the low contact resistance cannot be set sufficient so as to cause the rush current to flow to the contact pair low in the contact resistance before termination of the rush current flow through the contact pair high in the fusion-bonding resistance and thus the risk of the fusion-bonding still remains unsolved.

SUMMARY OF THE INVENTION

A primary object of the present invention is, therefore, to provide an electromagnetic relay which is improved in contacting stability at the contact pair low contact resistance upon the contact opening and closing operation and also in the operational efficiency of the electromagnet means, and which can effectively cope with the rush current made to flow for a relatively long time so as not to cause any fusion-bonding at the pair of contacts of low contact resistance, rendering the relay to be sufficiently reliable.

According to the present invention, this object can be realized by means of an electromagnetic relay wherein an electromagnet means includes an armature provided for engaging and disengaging motion with respect to a magnetic pole part, an opening and closing contact means includes a high fusion-bonding resistant contact pair and a low contact-resistance contact pair, which pairs being connected mutually in parallel relationship and respectively having a movable contactor carrying a movable contact of the pair and caused to rock in response to the engaging and disengaging motion of the armature with respect to the magnetic pole part in the electromagnet means, and the high fusion-bonding resistant contact pair are closed prior to the low contact-resistance contact pair, wherein the high fusion-bonding resistant and low contact-resistance contact pairs are disposed to oppose each other with an actuator of the electromagnet means interposed between them.

Other objects and advantages of the present invention shall become clear as the description of the invention referred to with reference to embodiments shown in accompanying drawings.

Figure 1:
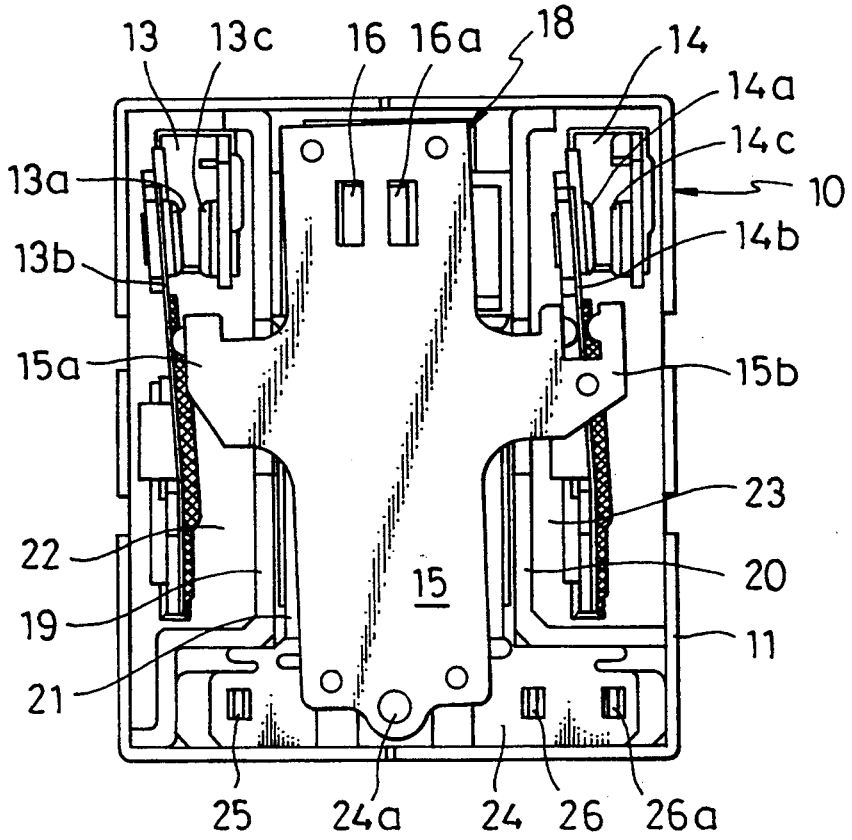
FIG. 1 shows in an interior plan view an embodiment of the electromagnetic relay according to the present invention.

While the present invention should now be described with reference to the respective embodiments shown in the drawings, it should be appreciated that the intention is not to limit the invention only to these embodiments shown but rather to cover all alterations, modifications and equivalent arrangements possible within the scope of appended claims.

DETAILED DESCRIPTION OF THE PREFERRED EMBODIMENTS

Figure 2:
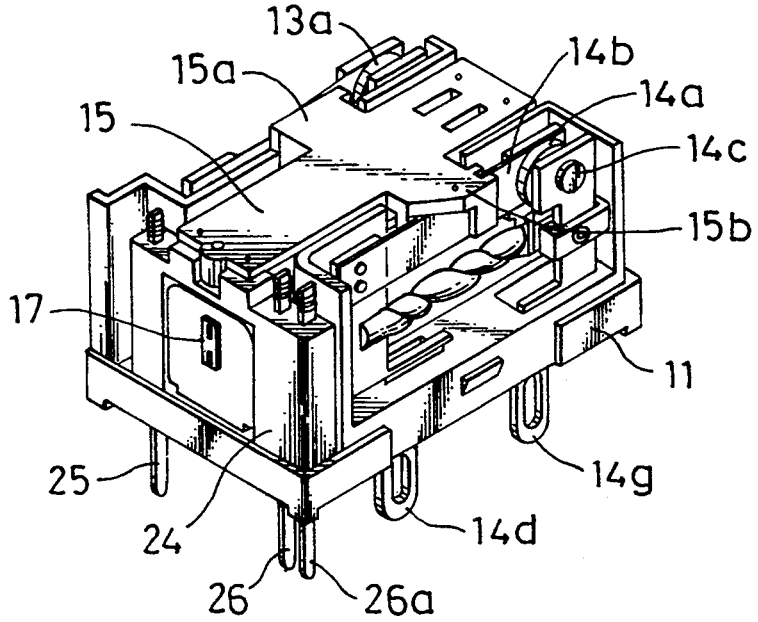
FIG. 2 shows in a perspective view the interior of the relay shown in FIG. 1.
Figure 3:
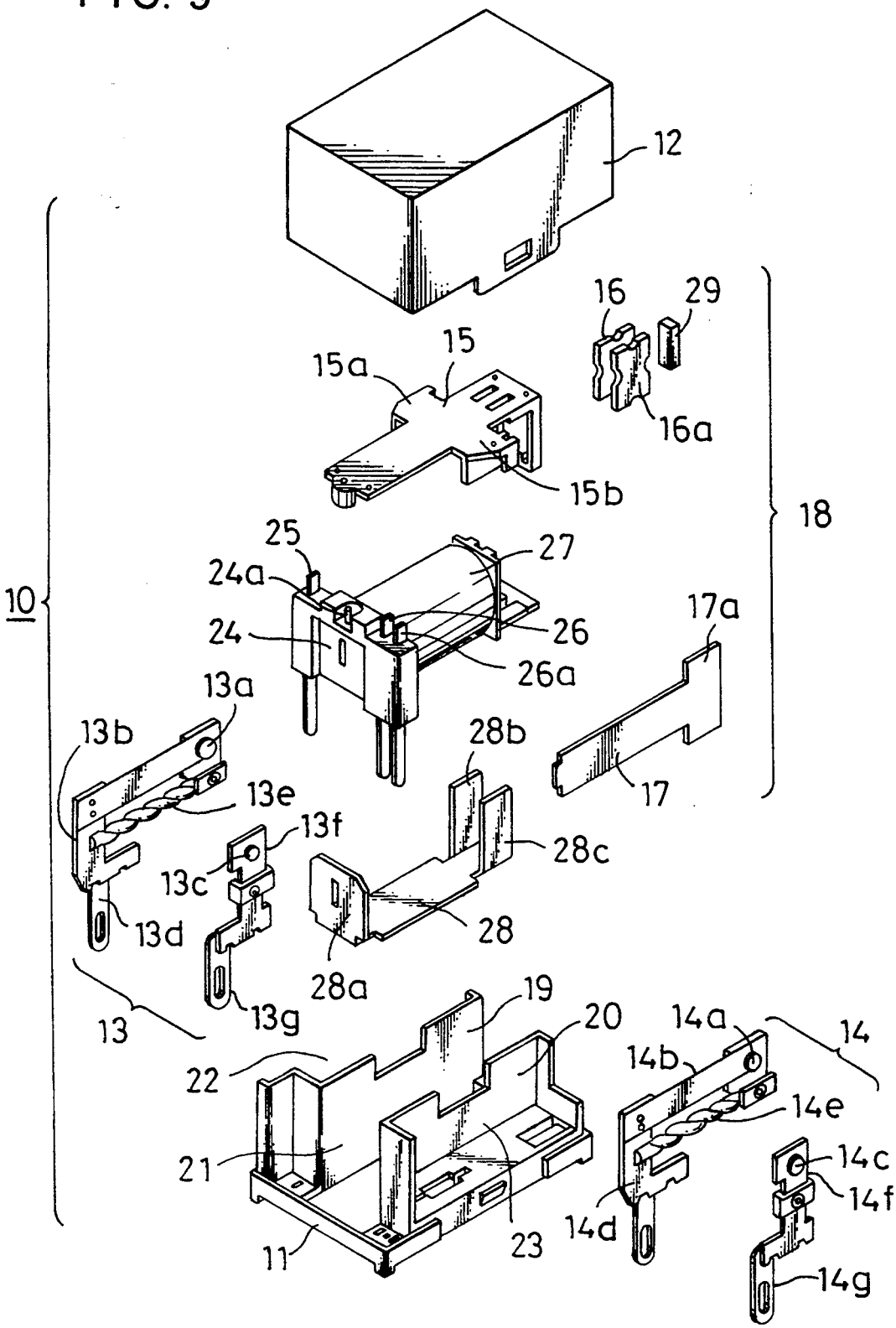
FIG. 3 is a perspective view as disassembled into essential constituents of the electromagnetic relay of FIG. 1.

Referring to FIGS. 1 to 3, there is shown an embodiment of the electromagnetic relay according to the present invention, in which this electromagnetic relay 10 generally comprises a base member 11 and a cover member 12 fitted over the base member 11, so as to constitute a casing with these members 11 and 12, within which casing there are housed an opening and closing contact means including a contact pair 13 of high fusion-bonding resistance excellent in the fusion-bonding resistance and a further contact pair 14 of low contact resistance excellent in the contact resistance, and a bistable type electromagnet means 18 including an actuator 15 for opening and closing operation of the two contact pairs 13 and 14 with a pair of armature pieces 16 and 16*a* carried by the actuator 15, and a stationary core plate 17 having a magnetic pole part 17*a* with respect to which the armature pieces 16 and 16*a* engage and disengage.

More specifically, the base member 11 has partitions 19 and 20 erected mutually in parallel as spaced in widthwise direction of the base member 11 so as to define, in conjunction with inner side walls of the cover member 12, a central chamber 21 and both side chambers 22 and 23 within the casing. In the central chamber 21, the electromagnet means 18 including actuator 15 as a movable frame is housed. The electromagnet means 18 further comprises a coil bobbin 24 carrying coil terminal conductors 25, 26 and 26*a* partly embedded in the bobbin and a coil 27 wound on axial body part of the bobbin for flowing through the coil an electric current alternately in reverse direction through the terminal conductors 25, 26 and 26*a*. Axially through this coil bobbin 24, the stationary core plate 17 is passed to secure a base end of the plate opposite to the end having the pole part 17*a* to a support end 28*a* of a yoke 28 substantially U-shaped in side view to have at the other end a pair of parallel magnetic pole parts 28*b* and 28*c* to oppose both side surfaces of the pole part 17*a* of the stationary core plate 17. The coil terminal conductors 25, 26 and 26*c* provided as partly embedded to the coil bobbin 24 are preferably led out of the base member 11 in downward direction.

The actuator 15 is pivotably supported at a longitudinal end to a pivot pin 24*a* on the coil bobbin 24, the armature pieces 16 and 16*a* are secured to the other rocking side end of the actuator 15 so as to be disposed respectively between the opposing magnetic pole parts 17*a* and 28*b* and between the pole parts 17*a* and 28*c*, and a permanent magnet 29 is secured as disposed between the armature pieces 16 and 16*a*. Further, the actuator 15 is provided at both side edges in widthwise direction with actuating peojections 15*a* and 15*b*.

Housed in one side chamber 22 in the casing are the high fusion-bonding resistant contact pair 13, while in the other side chamber 23 the low contact-resistance contact pair 14 are housed. These contact pairs 13 and 14 comprise respectively a movable contactor 13*b* or 14*b* carrying a movable contact 13*a* or 14*a*, and these movable contactors 13*b* and 14*b* are provided for engagement with the actuating projections 15*a* and 15*b*. Further, the movable contactors 13*b* and 14*b* are joined with terminal conductors 13*d* and 14*d* which are led out downwardly of the base member 11, and are provided, if required, with large current bypassing wires 13*e* and 14*e*, respectively, whereas the stationary contacts 13*c* and 14*c* are secured to stationary contactors 13*f* and 14*f* which are joined with terminal conductors 13*g* and 14*g* led out downwardly of the base member 11. Here, the movable contacts 13*a* and 14*a* of the movable contactors 13*b* and 14*b* are so provided as to be engageable with and disengageable from stationary contacts 13*c* and 14c in response to rocking motion of the movable contactors 13b and 14b following the rocking motion of the actuator 15. The high fusion-bonding resistant contact pair 13 should preferably be in a lift-off type, i.e., as normally closed contacts, while the low contact-resistance contact pair 14 should preferably be in a flexure type, i.e., as normality open contacts.

Figure 4A:
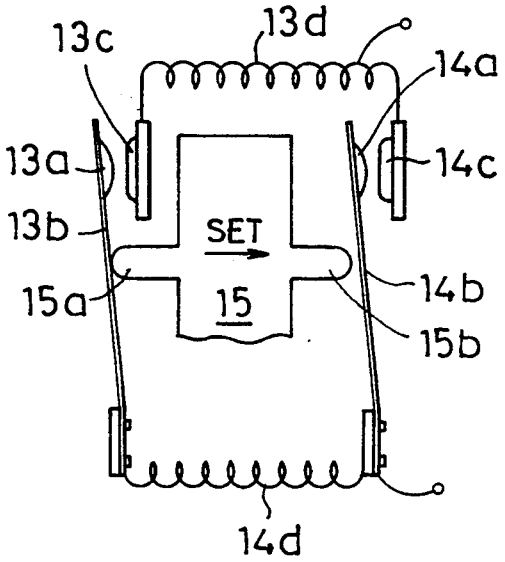
FIGS. 4A through 4D are explanatory views for the operation of the relay of FIG. 1.
Figure 4B:
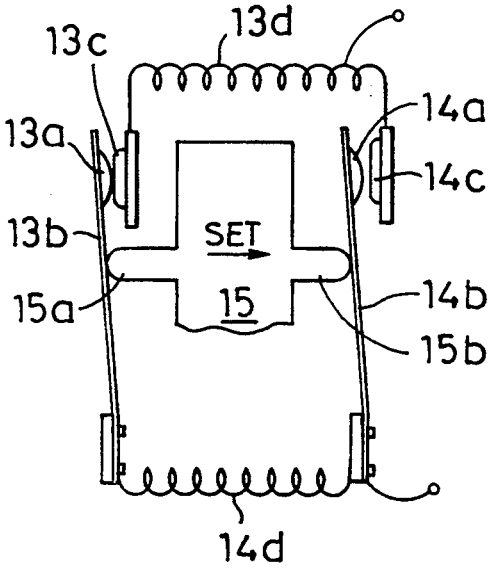
Figure 4C:
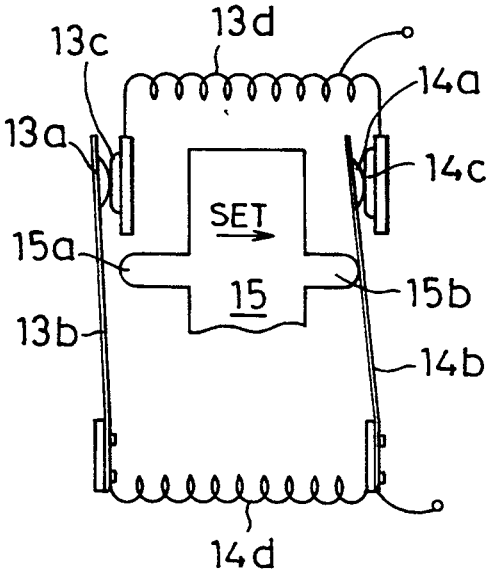
Figure 4D:
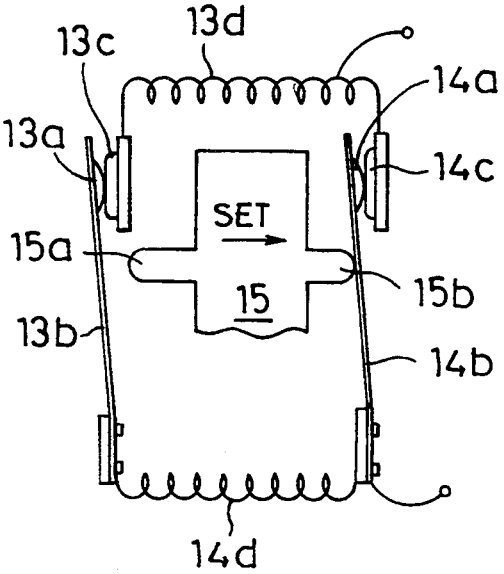

Referring here to the operation of the present embodiment with reference also to FIG. 4, the electric current supply in one direction to the coil 27 of the electromagnet means 18 in the relay 10 causes the armature pieces 16 and 16a integral with the actuator 15 to be attracted to the magnetic pole parts 17a and 28b of the stationary core plate 17 and yoke 28 on the side of the high fusion-bonding resistant contact pair 13, the actuator 15 is thereby rocked to the side of the high fusion-bonding resistant contact pair 13, and both of the high fusion-bonding resistant contact pair 13 and the low contact resistance contact pair 14 are opened (see FIG. 4A). When on the other hand the electric current in opposite direction is supplied to the coil 27 of the electromagnet means 18, the armature pieces 16 and 16a of the actuator 15 are attracted to the pole parts 17a and 28c of the stationary core plate 17 and yoke 28 on the side of the low contact-resistance contact pair 14, upon which attraction the high fusion-bonding resistant contact pair 13 are first closed (see FIG. 4B), the actuator 15 is further made to rock to the side of the low contact-resistance contact pair 14, and the contact pair 14 are then closed in addition to the high fusion-bonding resistant contact pair 13 (see FIG. 4C). As the actuator 15 keeps to further rock to the side of the low contact-resistance contact pair 14 so as to act exclusively onto the low contact-resistance contact pair 14 only, the high fusion-bonding resistant contact pair 13 of the lift-off type keep their closed state with own normally closing spring force of the movable contactor 13b, and the low contact-resistance contact pair 14 of the flexure type are urged by the rocked actuator 15 into the closed state, respectively under a sufficient contact pressure (see FIG. 4D).

Figure 5:
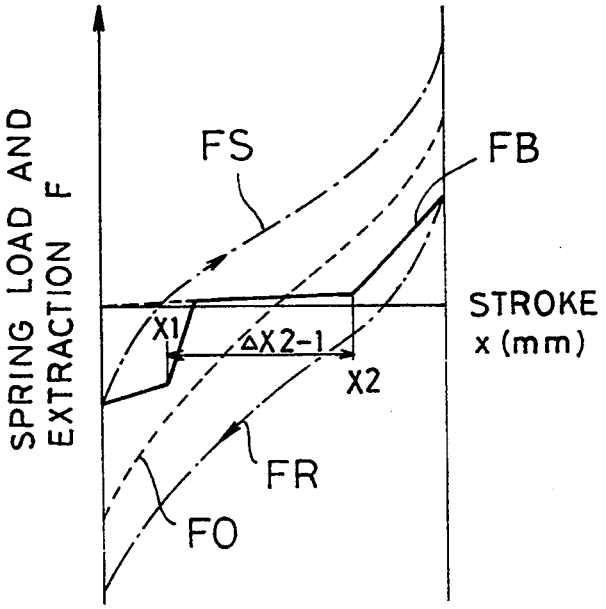
FIGS. 5 and 6 are diagrams for explaining the operation of the relay of FIG. 1.

In FIG. 5, there are shown spring load and attraction characteristic curves of the movable contactors 13b and 14b of the respective contact pairs 13 and 14 upon the operation of the instant embodment, wherein rocking stroke, i.e., displacing distance of the actuator 15 of the electromagnet means 18 is taken on the abscissa, and the spring load and attraction force are taken on the ordinate. In the drawing, a solid line curve FB denotes the spring load, a chain-line curve FS denotes the attraction force upon the actuation, another chain-line curve FR denotes the attraction force upon interruption, and a dotted-line curve OF denotes the attraction force upon non excitation. As will be apparent from the drawing, the spring load upon the actuation is reversed in the direction upon closing of the high fusion-bonding resistant contact pair 13 at a time x1 of the stroke, and is again increased upon closing of the low contact-resistance contact pair 14 at a time x2 of the stroke. In other words, the spring load is reversed in the direction during former and latter halves of the stroke, the attraction force characteristics are well balanced, and the electromagnet means 18 is improved in the efficiency.

Figure 6:
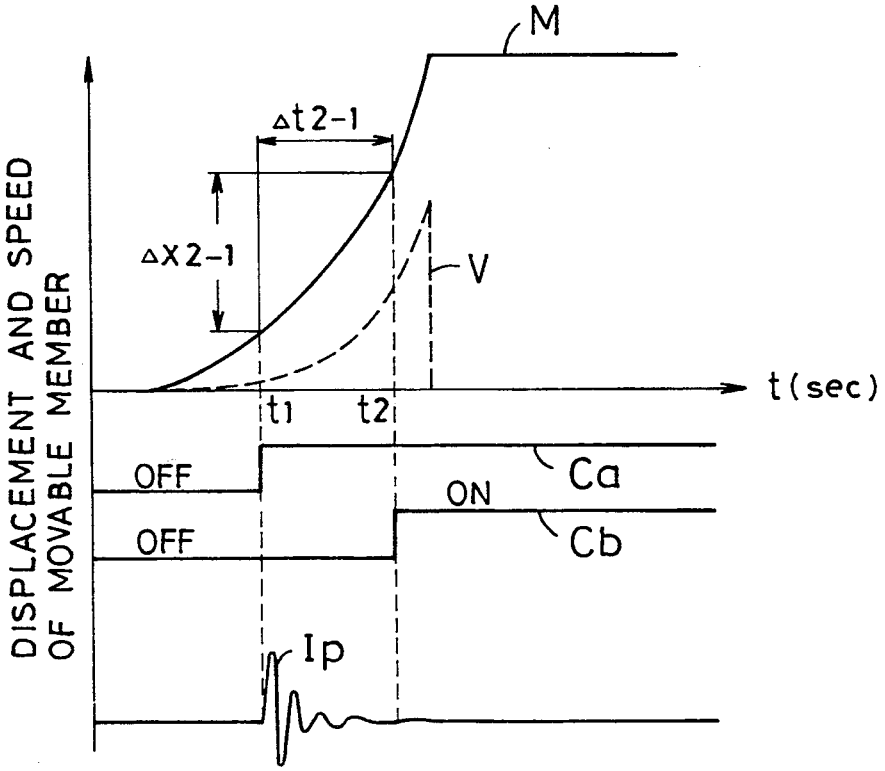

In FIG. 6, the operational characteristics the contact pairs in the foregoing embodiment are shown, in which the time is taken on the abscissa, and the displacement M and displacing velocity V of the movable contacts in the electromagnet means 18 are taken on the ordinate. As will be clear from the drawing, the high fusion-bonding resistant contact pair 13 are closed at time t1, and the low contact-resistance contact pair 14 are closed at time t2. A displacing (stroke) difference Δx2-1 between the closing of the high fusion-bonding resistant contact pair 13 at the time t1 and the closing of the low contact-resistance contact pair 14 at the time t2 is shown to be larger than that in any known relay (see also FIG. 5), and the curve of the velocity V of the movable contacts in the electromagnet means 18 involves a range in which the velocity does not become sufficiently high, so that a closing time difference Δt-1 between the initial closing of the high fusion-bonding resistant contact 13 and the later closing of the low contact-resistance contact pair 14 can be made longer and, consequently, the low contact-resistance contact pair 14 can be restrained from being closed during the presence of the rush current so as to render the fusion bonding of the contacts to less occur. In FIG. 6, a waveform Ca denotes the opening and closing state of the high fusion-bonding resistant contact pair 13, a waveform Cb denotes the opening and closing state of the low contact-resistance contact pair 14, and a further waveform Ip denotes the rush current.

As has been described above, the low contact-resistance contact pair 14 are restrained from closing during the presence of the ruch current Ip and, in addition, the high fusion-bonding resistant contact pair 13 and the low contact-resistance contact pair 14 are mutually sufficiently separated with the electromagnet means 18 interposed between them so that, even upon occurrence of an arc in the high fusion-bonding resistant contact pair 13, ambient temperature of the low contact-resistance contact pair 14 can be effectively prevented from rising.

Figure 7:
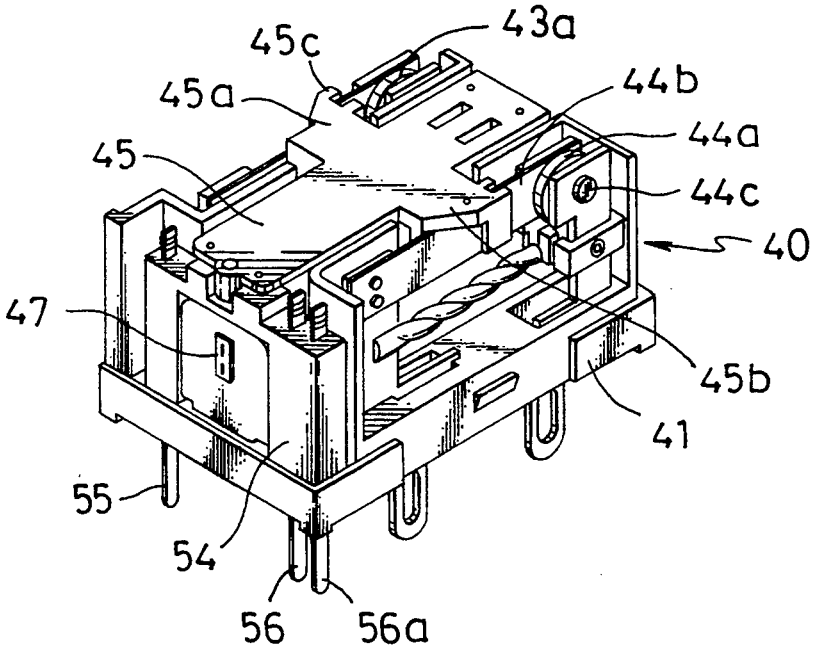
FIG. 7 shows in a perspective view the interior in another embodiment of the electromagnetic relay according to the present invention.

In FIG. 7, another embodiment of the electromagnetic relay according to the present invention is shown, in which the actuator 45 is provided at the actuating projection 45a on the side of the high fusion-bonding resistant contact pair 43 with a further extended actuating projection 45c formed to have the movable contactor 43b of the high fusion-bonding resistant contact pair 43 disposed between the actuating projection 45a and the extended actuating projection 45c. As shown in FIG. 8, according to this embodiment, the movable contactor 43b of the high fusion-bonding resistant contact pair 43 in the interrupted state of the relay 40 is urged outward by the actuating projection 45a of the actuator 45 to be separated from the stationary contact 43c while the movable contactor 44b of the low contact-resistance contact pair 44 freed from the actuating projection 45b of the actuator 45 is separated by its own resiliency, and both contact pairs 43 and 44 are in the open state (see FIG. 8A). As the one directional current Is supplied to the coil of the electromanget means, the actuator 45 starts to rock towards the side of the low contact-resistance contact pair 44 to have the high fusion-bonding resistant contact pair 43 closed first (see FIG. 8B), then the actuating projection 45a separates from the movable contactor 43b of the high fusion-bonding resistant contact pair 43 whereas the other actuating projection 45b starts urging outward the movable contactor 44b of the low contact-resistance contact pair 44 so as to have both contact pairs 43 and 44 brought into the closed state (see FIG. 8c), and thereafter the outer extended actuating projection 45c of the actuator 45 starts urging the movable contactor 43b of the high fusion-bonding resistant contact pair 43 inward (see FIG. 4D) so that both contact pairs 43 and 44 will be eventually tightly closed (see FIG. 8E). In order to have the actuator 45 rocked inversely, the electric current is to be supplied to the coil of the electromagnet means in reverse direction to that in the above.

Figure 9:
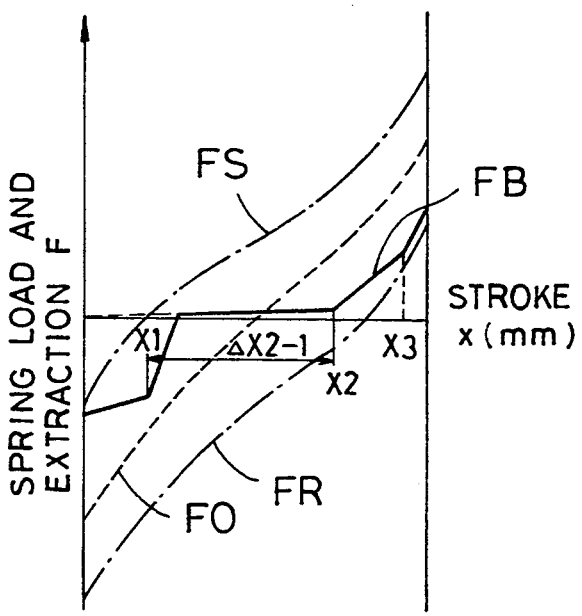
FIG. 9 is a diagram for explaining the operation of the relay of FIG. 7.
Figure 8A:
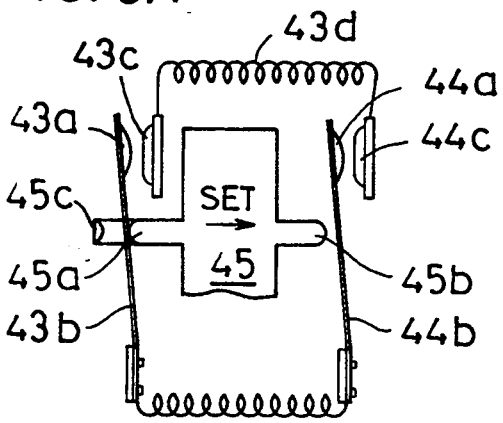
FIGS. 8A through 8E are explanatory views for the operation of the relay of FIG. 7.
Figure 8B:
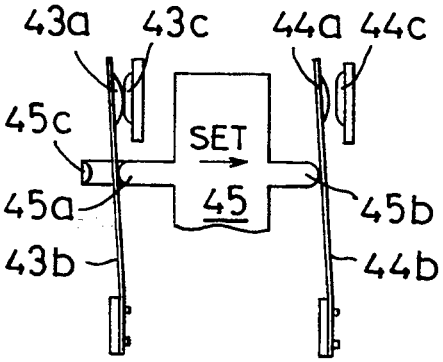
Figure 8C:
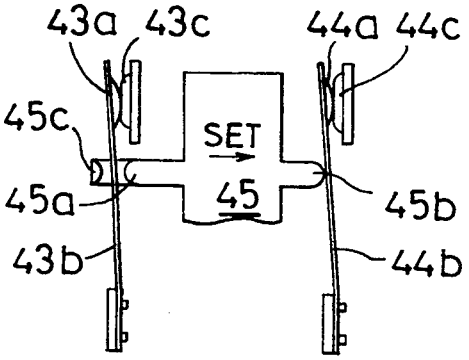
Figure 8D:
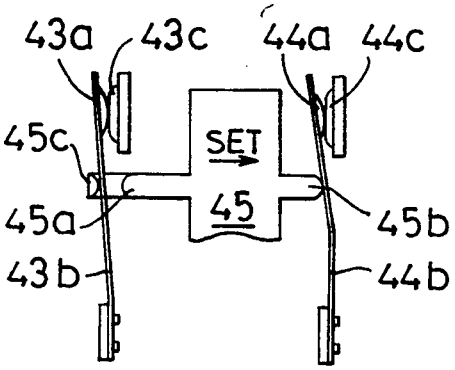
Figure 8E:
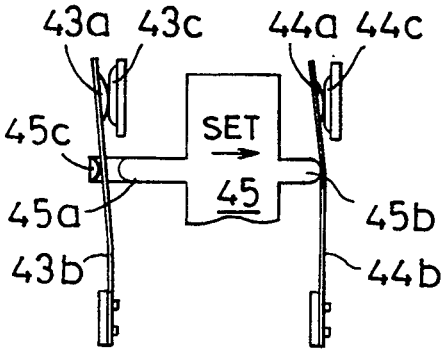

In the instant embodiment, as will be clear when such characteristic curves as in FIG. 9 are compared with those in FIG. 5, the urging force of the outer extended actuating projection 45*c* of the actuator 45 is to be additionally applied to the movable contactor 43*b* at a time x3 in the stroke of the actuator 45 so that, when the spring load is reversed in the former and latter halves of the rocking stroke of the actuator 45, the attraction force characteristics will be further well balanced.

In the present embodiment, too, both contact pairs 43 and 44 are sufficiently separated from each other with the electromagnet-means interposed between them, of course, so that any influence of an arc occurrence if any in the high fusion-bonding resistant contact pair 43 on the low contact-resistance contact pair 44 can be minimized.

In the embodiment of FIGS. 7 to 9, all other constituents and functions are substantially the same as those in the foregoing embodiment of FIGS. 1 to 6, and are denoted in FIGS. 7 and 8 by the same reference numbers as those used in FIGS. 1 to 4 but with "30" added thereto.

Figure 10A:
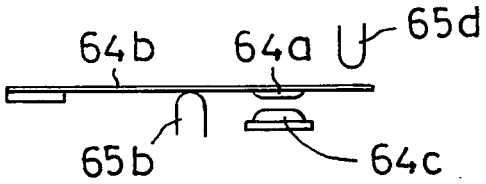
FIGS. 10A through 10F are explanatory views for explaining the operation of another embodiment of the electromagnetic relay according to the present invention.
Figure 10B:
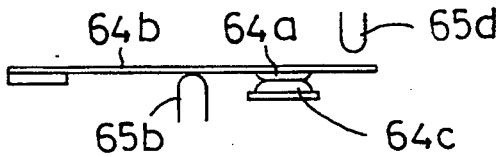
Figure 10C:
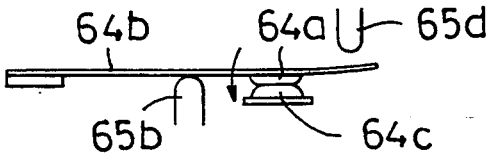
Figure 10D:
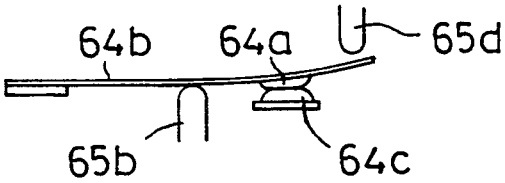
Figure 10E:
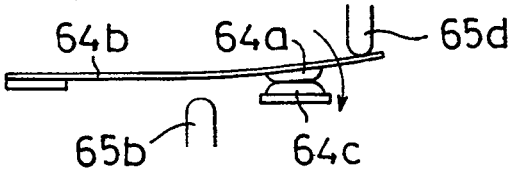
Figure 10F:
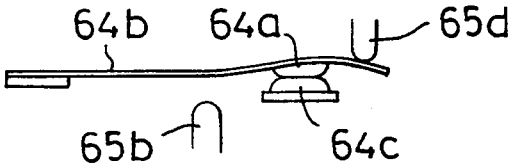

In a working aspect of the present invention, on the other hand, a measure for preventing the fusion bonding can be taken in respect of the low contact-resistance contact pair or the high fusion-bonding resistant contact pair in the opening and closing contact means, by providing, for example, the actuating projections on at least one side of the actuator at positions of point symmetry with respect to the contact pair as the center. Referring more specifically to this, with reference to FIG. 10, the actuating projections 65*b* and 65*d* are disposed in the point symmetry with respect to the contact pair of the movable contact 64*a* on the movable contactor 64*b* and the stationary contact 64*c* so that, as shown in particular in FIGS. 10E and 10F, the fusion bonding occurred at the contact pair can be blocked by means of a so-called rolling action caused between both contacts 64*a* and 64*c* particularly by the actuating projection 65*d* on outer side which bends the movable contactor 64*b* to roll the movable contact 64*a* with respect to the stationary contact 64*c*.

Figure 12:
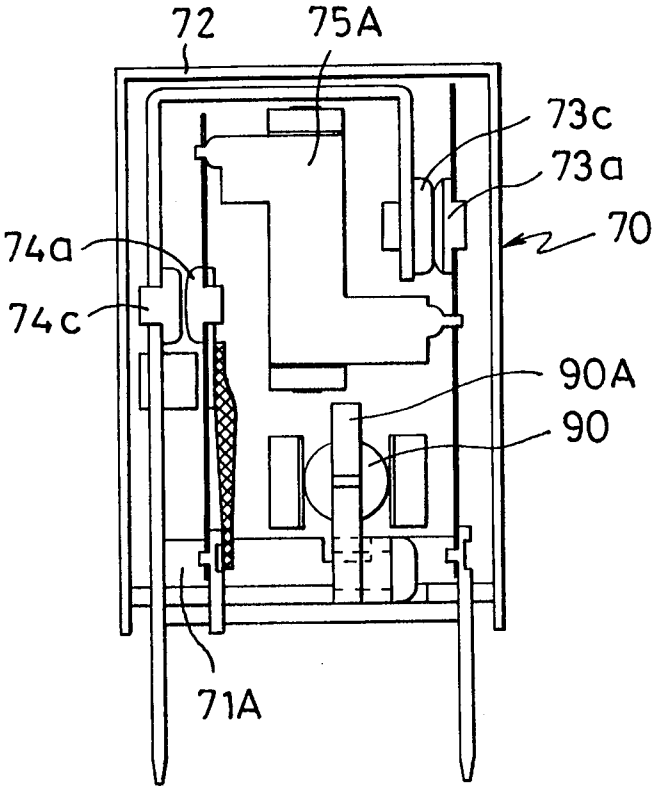
FIG. 12 is an interior side view of the relay of FIG. 11.
Figure 11:
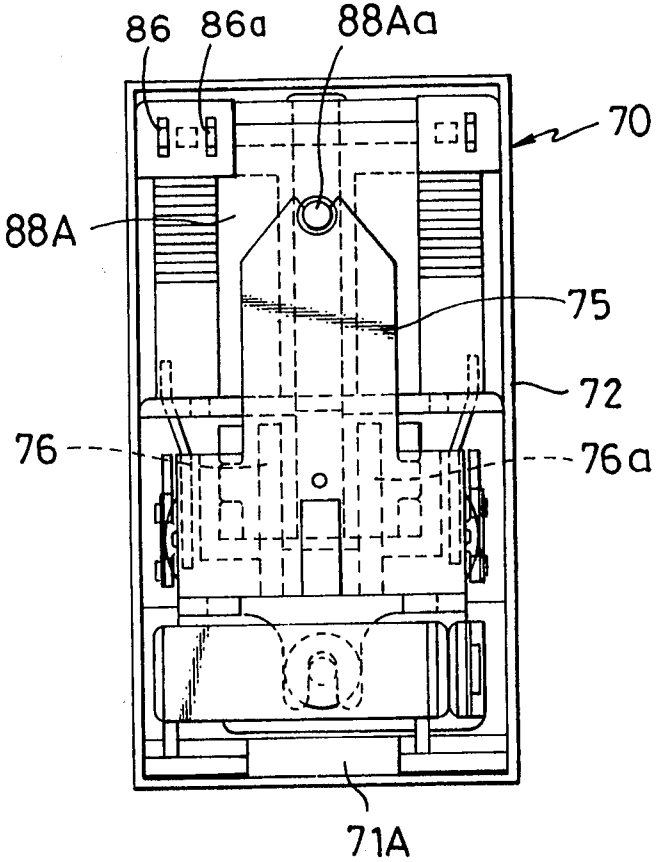
FIG. 11 is an interior plan view of a further embodiment of the electromagnetic relay according to the present invention.
Figure 13:
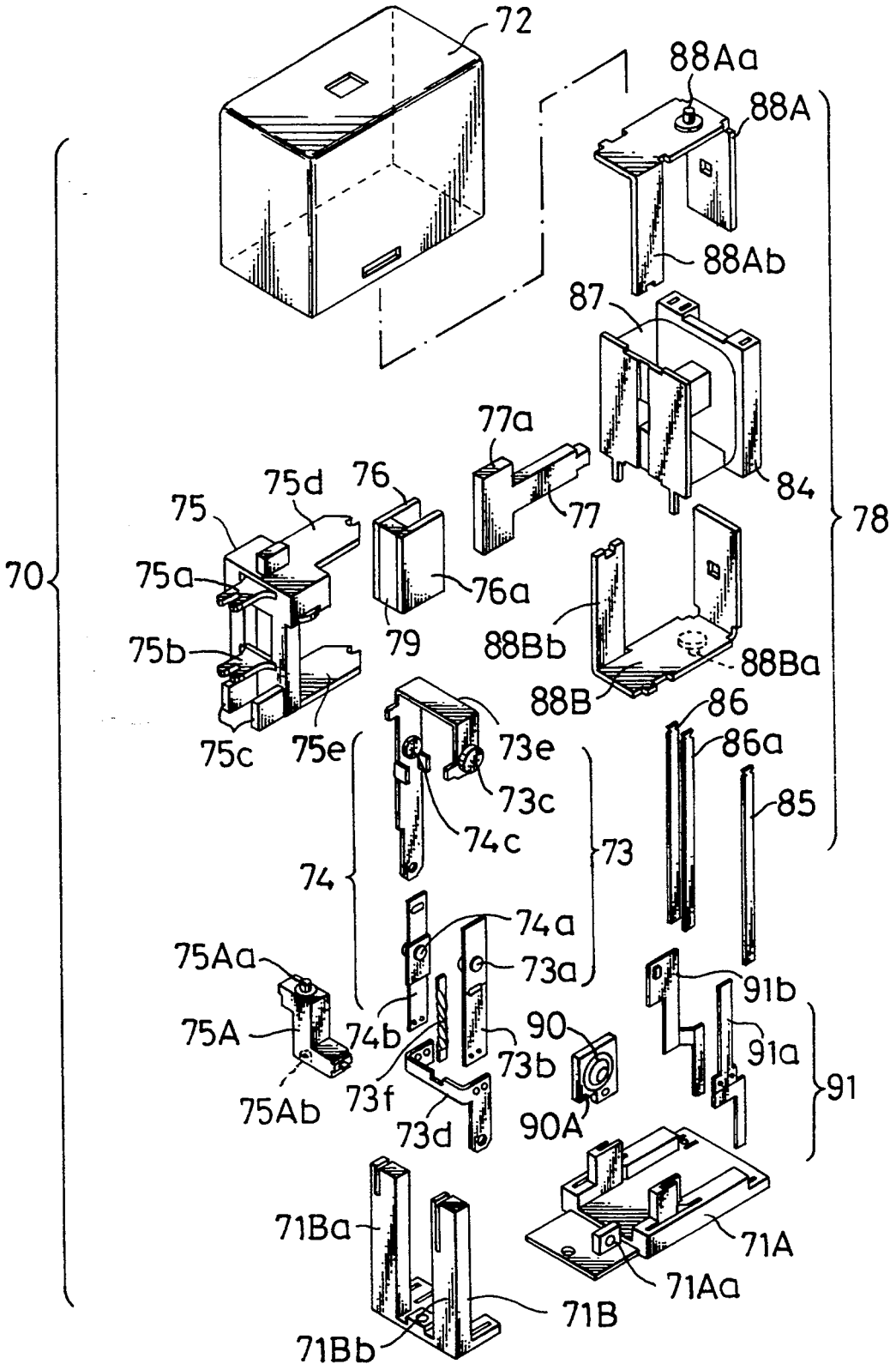
FIG. 13 is a perspective view as disassembled of the relay shown in FIG. 11.

Referring next to FIGS. 11 to 13, there is shown still another embodiment of the present invention, which is provided as a vertical type electromagnetic relay 70, in contrast to the foregoing relay 10 of FIGS. 1 to 3 which is a horizontal type, while this relay 70 is also featured substantially in the same respects as the foregoing relay 10. The relay 70 comprises a casing consisting of a set of two divided base members 71A and 71B and a single cover member 72, in which casing the opening and closing contact means including the high fusion-bonding resistant contact pair 73 and low contact-resistance contact pair 74 as well as the bistable type electromagnet means 78 including the actuators 75 and 75A for the opening and closing operation of the contact pairs 73 and 74, the armature pieces 76 and 76*a* operating integral with the actuators 75 and 75A and the stationary core plate 77 having the magnetic pole part 77*a* with which the armature pieces 76 and 76*a* are engageable, are housed. In this case, one actuator 75 is formed to have a pair of upper and lower arms 75*d* and 75*e* extended mutually in parallel relationship.

The electromagnet means 78 further includes the coil bobbin 84, on which the coil 87 is wound for the electric current supply alternately in opposite direction through the coil terminal conductors 85, 86 and 86*a* which are led downward out of the base member 71A. The stationary core plate 77 is passed axially through the coil bobbin 84, so that one base end of the plate 77 will be fitted in support holes made in at least one support end of each of a pair of divided yoke members 88A and 88B, while the other end of the stationary core plate 77 is formed to be the magnetic pole part 77*a*. The pair of yoke members 88A and 88B are formed mutually in a point symmetry to have on one side at the other end parts connecting parts 88A*b* and 88B*b* to be mutually oppose within the casing. The yoke member 88A is provided on top face with a pivot projection 88A*a*, and the other yoke member 88B is provided on bottom face with a further pivot projection 88B*a*, so that, when the pair of the yoke members 88A and 88B are assembled to the coil bobbin 84 above and below, extended pivot ends of the upper and lower arms 75*d* and 75*e* of the actuator 75 will pivotably engage with the top and bottom pivot projections 88A*a* and 88B*a* and the other end parts of the yoke members 88A and 88B as well as their connecting parts 88A*b* and 88B*b* are arranged to form a square shape as viewed from rocking end side of the actuator 75, in which square shape the magnetic pole part 77*a* of the stationary core 77 will be disposed.

Figure 13B:
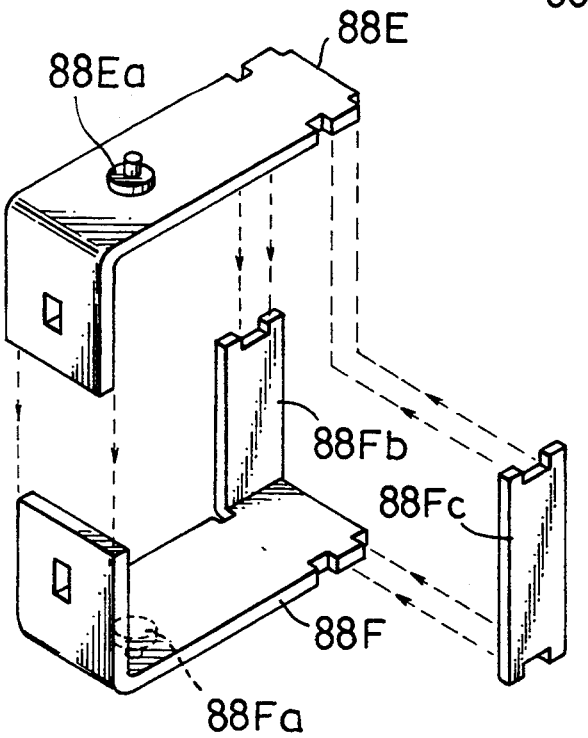
FIGS. 13*a* through 13*k* show in perspective views various aspects of the yoke respectively employable in the electromagnetic relay of FIG. 13.
Figure 13A:
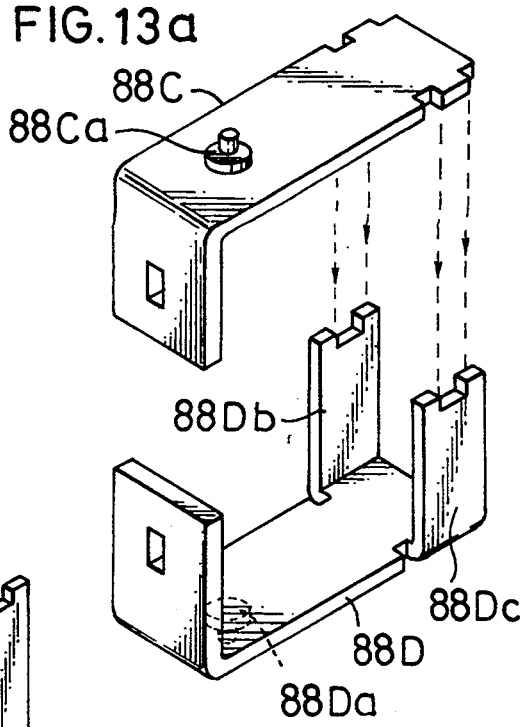
Figure 13C:
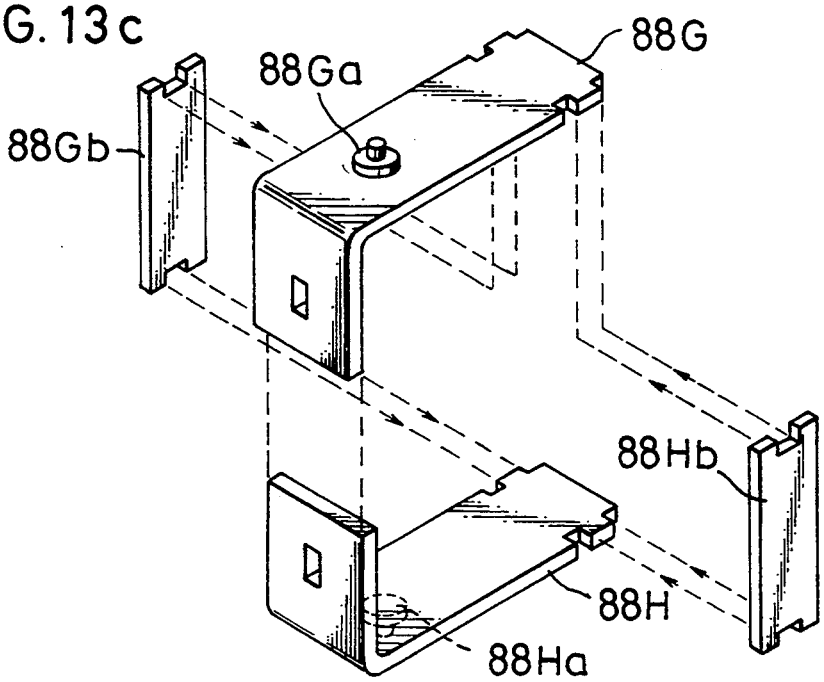

In the above, the pair of the yoke members 88A and 88B may be formed in various types. That is, as shown in FIG. 13*a*, one yoke member 88C may be formed in an L shape in side view whereas the other yoke member 88D may be formed to have a pair of the connecting parts 88D*b* and 88D*c* erected in parallel to oppose each other. As shown in FIG. 13*b*, further, one yoke member 88E may also be formed in the L shape in side view, the other yoke member 88F may have only one connecting part 88F*b*, and the other yoke member 88F*c* may be provided separately and to be coupled across both of the members 88E and 88F in parallel to the connecting parts 88F*b*. In an aspect of FIG. 13*c*, both yoke members 88G and 88H are formed in the L shape, and a pair of the connecting parts 88G*b* and 88H*b* are provided as separate members which are coupled across both yoke members 88E and 88F on both sides thereof to be mutually in parallel. Throughout these aspects of FIGS. 13*a* to 13*c*, bent leg parts as the core supporting end parts of the U-shaped yoke members are stacked face to face when assembled with respect to the coil bobbin, so that the base end of the stationary core plate passed axially through the coil bobbin will be fixed to these stacked supporting end parts.

Figure 13D:
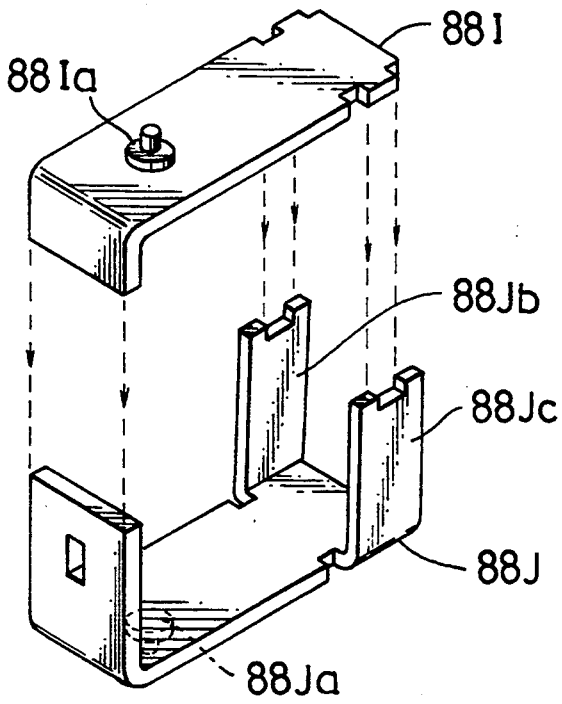
Figure 13E:
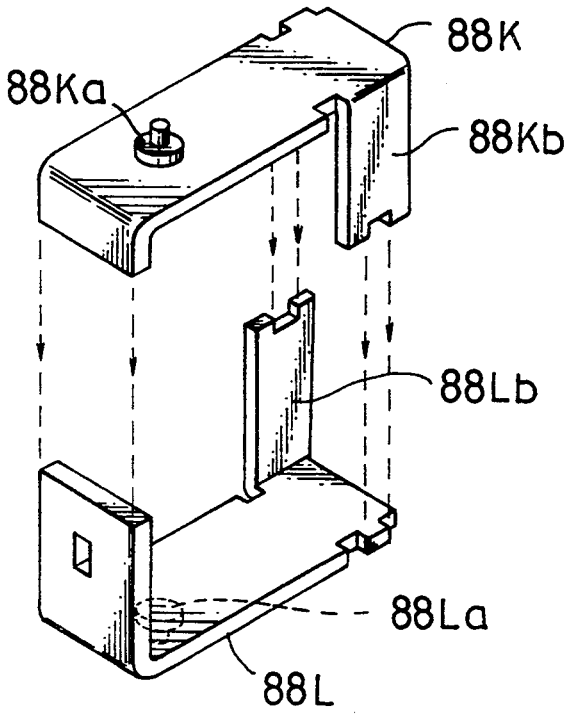
Figure 13F:
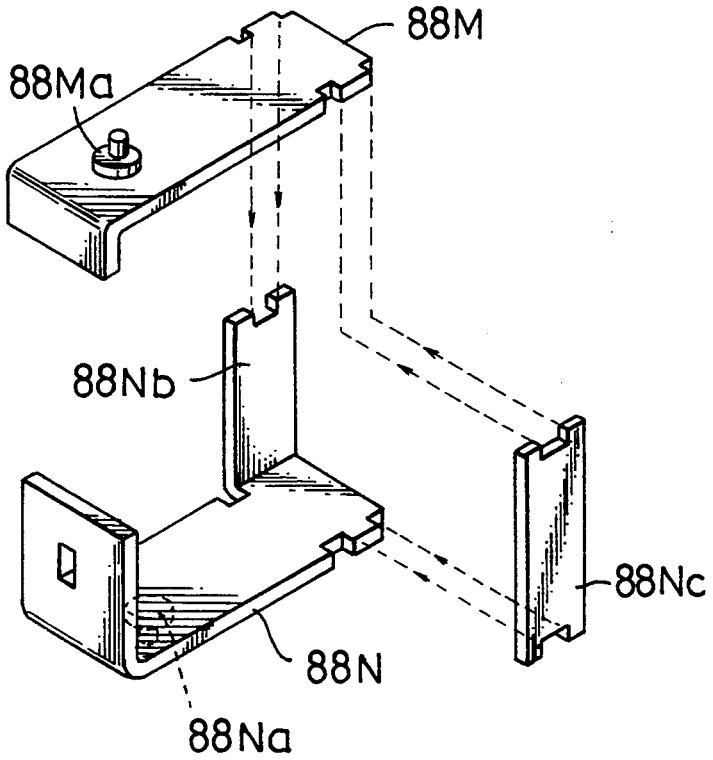
Figure 13G:
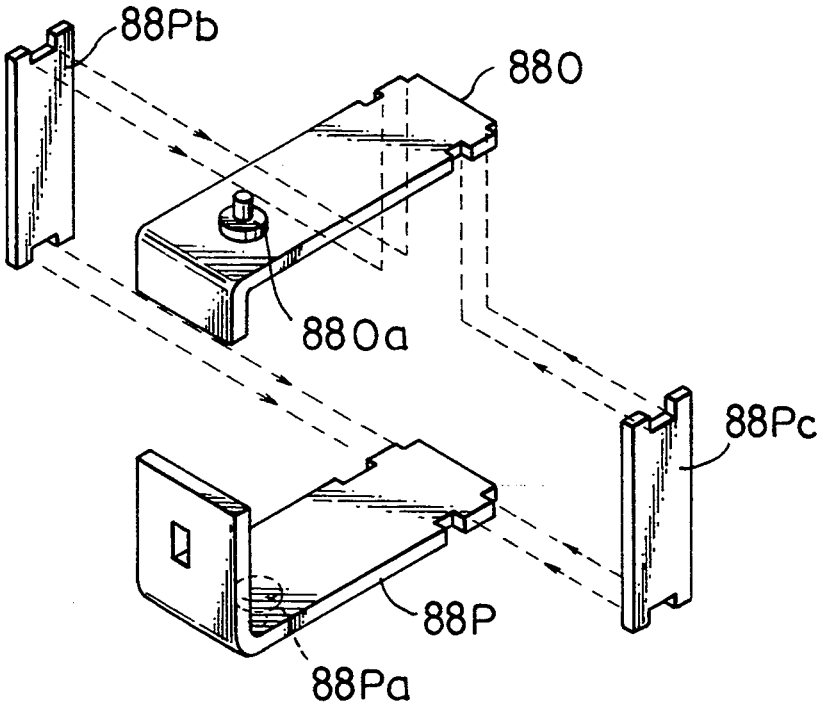

As shown in FIGS. 13*d* to 13*g*, on the other hand, the yoke employed in the relay of the present invention may be formed to connect edgewise the bent supporting leg parts of the pair of the L-shaped yoke members thus, in an aspect shown in FIG. 13*d*, one yoke member 88I is L-shaped to have a relatively shorter leg part, whereas the other yoke member 88J is also L-shaped but to have a relatively longer leg part for supporting the base end of the stationary core as well as a pair of the connecting parts 88J*b* and 88J*c* erected in parallel to oppose each other. In an aspect of FIG. 13*e*, the yoke members 88K and 88L are L-shaped to have such shorter leg part and longer core-supporting leg part as in the aspect of FIG. 13*d* and are respectively made to have each of the connecting parts 88K*b* and 88L*b* erected to oppose in parallel when assembled. In an aspect of FIG. 13*f*, the yoke members 88M and 88N are L-shaped to have also the shorter leg part and longer core-supporting leg part as in the above, the yoke member 88N is made to have one 88N*b* of the pair of connecting parts, and the other connecting part 88N*c* is separately prepared and connected across both of the yoke members 88M and 88N to be in parallel to the part 88N*b*. In a further aspect of FIG. 13*g*, the yoke members 880 and 88P are also L-shaped to have the shorter leg part and longer core-supporting leg part as in the above, and the pair of connecting parts 880*b* and 88P*b* are prepared separately and are coupled across both of the yoke members 880 and 88P to be in parallel to each other. In these aspects of FIGS. 13*f* to 13*g*, the shorter leg part and longer core-supporting leg of the yoke members are mutually coupled at their edge.

Figure 13H:
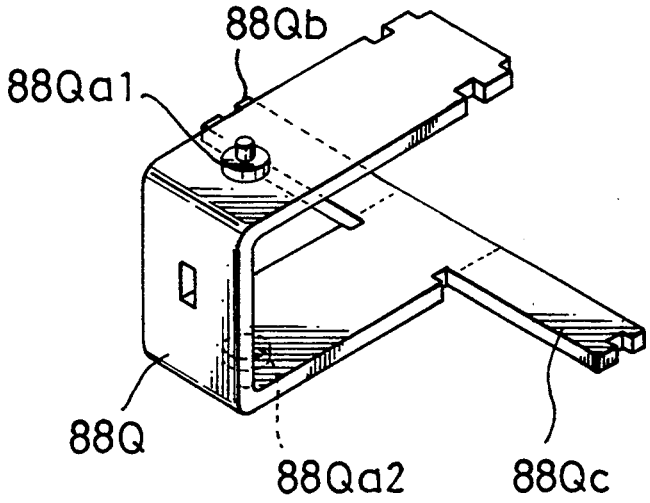
Figure 13I:
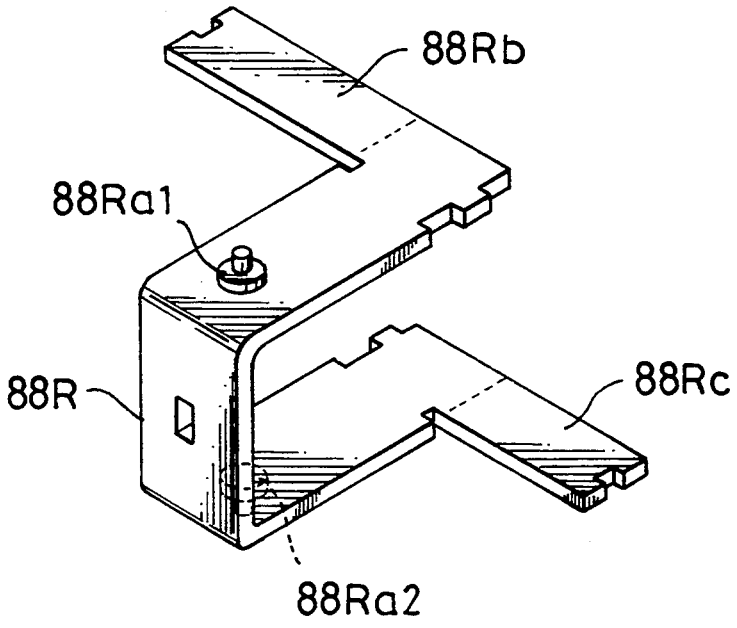
Figure 13J:
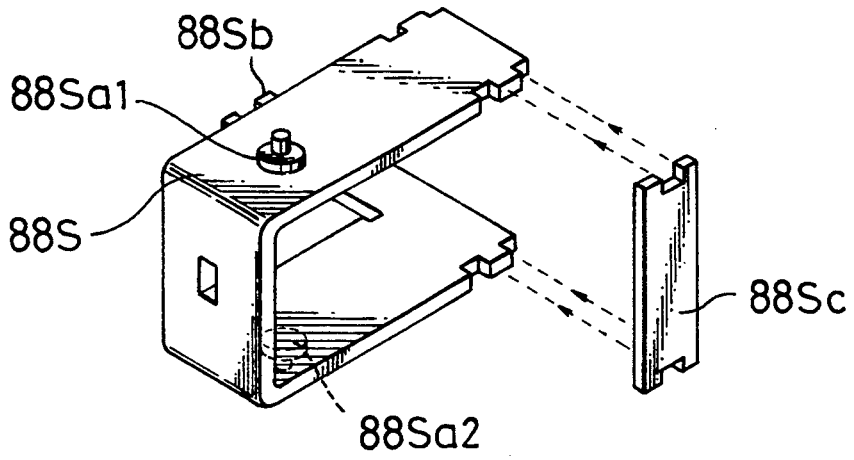
Figure 13K:
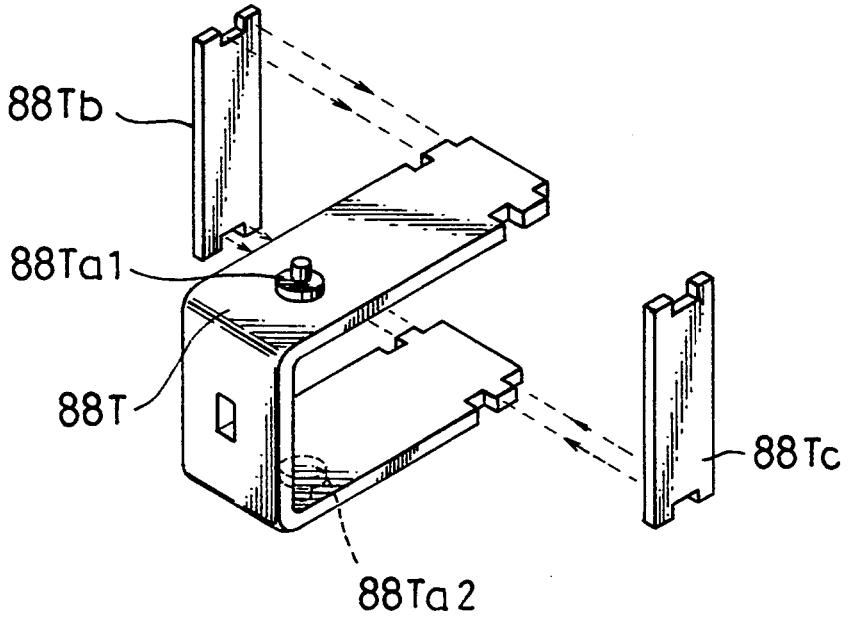

The yoke employed in the relay according to the present invention may of course be of such single member as shown in further aspects of FIGS. 13*h* to 13*k*, without being divided into two but in a U shape in side view. In the aspect of FIG. 13*h*, the single U-shaped yoke 88Q is made to have both side extensions 88Q*b* and 88Q*c* at an end of lower side arm, which extensions 88Q*b* and 88Q*c* being bent upward to be connected to opposing end of upper side arm from the state shown. In an aspect of FIG. 13*i*, the U-shaped yoke 88R is made to have upper and lower side arms respectively having each of sideward extensions 88R*b* and 88R*c* in opposite directions form their end parts, which extensions 88R*b* and 88R*c* being bent downward or upward to be the connecting parts across both upper and lower side arms. In an aspect of FIG. 13*j*, the yoke 88S is made to have at the lower side arm one 88S*b* of the connecting parts as a sideward extention which is bent upward, and the other connecting part 88S*c* is separately prepared and coupled across both side arms to be in parallel to the part 88S*b*. In a further aspect of FIG. 13*k*, a pair of the connecting parts 88T*b* and 88T*c* are separately prepared and are connected across both of the upper and lower side arms of the U-shaped yoke 88T to be mutually in parallel.

While the yoke or yoke members in any one of the foregoing aspects shown in FIGS. 13*a* to 13*k* may be effectively employed in the electromagnetic relay according to the present invention, it is important that the yoke provides a square shape as viewed from the rocking end side of the actuator 75, so that a square magnetic path will be formed on the rocking end side of the actuator. In the illustrated arrangements of the respective aspects, the respective connecting parts are acting as magnetic pole parts, but the respective end parts of the yoke or yoke members disposed between the connecting parts may be employed as the magnetic pole parts opposing the armature pieces in an event where the yoke is axially rotated by 90 degrees from the state shown in FIG. 13 and FIGS. 13*a*–13*k*, as will be readily appreciated.

With the formation of the square magnetic path by the yoke on the side opposing the rocking side end of the actuator, there arise such advantages that assembling direction of the yoke can be made properly selective, the relay can be made excellent in the assembling ability, and so on. Further, the yoke in the respective aspects of FIGS. 13*a* to 13*k* includes a pair of upward and downward pivoting projections for the upper and lower arms 75*d* and 75*e* of the actuator 75 as shown in FIG. 13 so that the actuator 74 can be pivotably supported at two points, the operation of the actuator 75 is made excellent in the pivoting balance, and the operational characteristics of the electromagnetic relay can be remarkably improved. In this case, the electromagnetic relay according to the present invention may be of an arrangement in which one 75 of the actuators, for example, is manually operatable from the exterior of the housing, in which event, too, the actuator 75 pivotably supported at two points allows the relay to be stably operated.

Referring back to FIG. 13, the one 75 of the two actuators 75 and 75A in the electromagnet means 78 is pivotably supported at such two points as the base ends of the pair of upper and lower arms 75*d* and 75*e*, which base ends being engaged respectively to the pivot projection 88A*a* on the top face of the yoke member 88A and to the further pivot projection 88B*a* on the bottom face of the other yoke member 88B so that the actuator 75 will be rockable at the other end, while the rockable side end of the actuator 75 is provided, as secured onto inner side of the end, with an opposing pair of the armature pieces 76 and 76*a* joined through the permanent magnet 79 interposed between them so as to be disposed respectively between the magnetic pole part 77*a* of the stationary core 77 and the magnetic pole part 88B*b* of the other yoke member 88B and between the pole part 77*a* and the magnetic pole part 88A*b* of the one yoke member 88A. Further, on the outer side of this rockable end of the actuator 75, there are provided a vertically opposing pair of supporting projections 75*a* and 75*b*, and the other actuator 75A generally Z-shaped in held between these supporting projections 75*a* and 75*b* at upward and downward projections 75A*a* and 75A*b* of the other actuator 75A. In the present instance, the other actuator 75A as held between the supporting projections 75*a* and 75*b* of the actuator 75 is positioned between the movable contactors 73*b* and 74*b* at the time of assembly, so that, in response to the rocking motion of the actuator 75, the other actuator 75A performs pushing and separating motion with respect to the movable contactors 73*b* and 74*b* for opening and closing the contact pairs 73 and 74.

In the high fusion-bonding resistant contact pair 73, the movable contact 73*a* made of such highly fusion-bonding resistant material as tungsten, preferably, is secured to the movable contactor 73*b*, while in the low contact-resistance contact pair 74 the movable contact 74*a* made of such low contact-resistance material as a silver alloy, preferably, is secured to the movable contactor 74*b*, and these movable contactors 73*b* and 74*b* are connected to a common terminal conductor 73*d* led out of the base member 71B. On the other hand, the stationary contact 73*c* preferably of such high fusion-bonding resistant material as tungsten and the stationary contact 74*c* of such low contact resistance material as a silver alloy are secured to a common contactor 73*e* which is led out of the base member 71B to function as another terminal conductor. If required, a large current bypassing wire 73*f* is provided, for example, to the movable contactor 74*b* of the low contact resistance contact pair 74 or to the terminal conductor 73*d*. In the present instance, too, the high fusion-bonding resistant and low contact-resistance contact pairs 73 and 74 should preferably be formed respectively in each of the lift-off and flexure types. In the one actuator 75, further, there are provided on the outer side of the rockable end with a horizontally opposing pair of damper engaging projections 75*c*, and a damper 90 connected to a stationary projection 71A*a* on the top face of the one base member 71A is freely disposed between these projections 75c. This damper 90 is formed as a compartment made by a sufficiently flexible material on both sides of a support plate 90A having a through hole for allowing an amount of fluid contained in the compartment to flow therethrough to move between both side parts in the compartment so that, upon application of an external force to one side part of the damper compartment, the one side part will collapse with the contained fluid to move to the other side part to inflate the same and a shock absorbing action will be attained on the one side part which has been initially inflated with the fluid (see FIGS. 13 to 18), the shock or the external force being transmitted by the damper engaging projections 75c.

Figure 19:
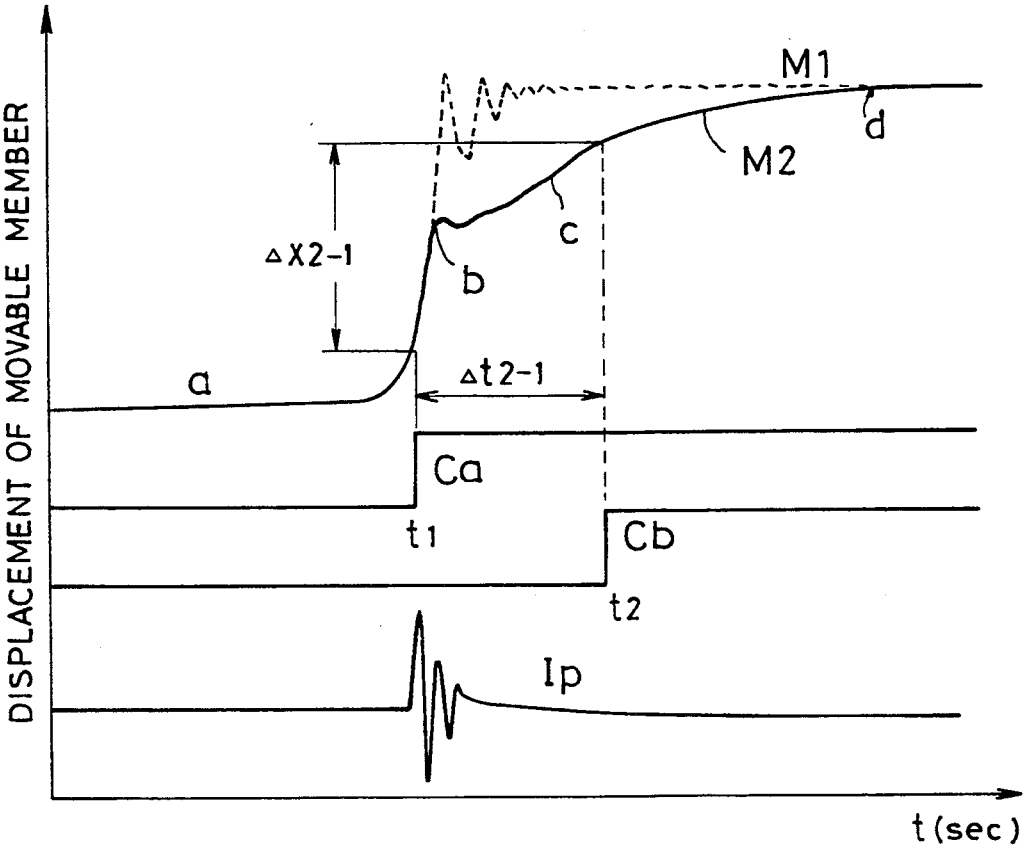
FIG. 19 is a diagram for explaining the operation of the electromagnetic relay of FIG. 11.

Referring more specifically to the action with reference to FIG. 19, displacing characteristics of the movable contacts in the contact pairs employing the damper 90 are represented by a dotted line curve M1 in contrast to a solid line curve M2 denoting the characteristics in the case where no damper is employed, showing that the fusion-bonding between the contact pair can be more effectively prevented. That is, in the drawing, time is taken on the abscissa while the displacement of the movable contact is taken on the ordinate, the high fusion-bonding resistant contact pair 73 are closed at time t1, and the low contact-resistance contact pair 74 are closed at time t2. In view of the curves, it will be appreciated that, with the shock absorbing act/on of the damper 90, the stroke difference Δx2-1 between the closing of the contact pair 73 and the closing of the contact pair 74 can be sufficiently enlarged. In the drawing, further, a current waveform Ca shows the opening and closing state of the high fusion-bonding resistance contact pair 73, a current waveform Cb represents the opening and closing state of the low contact-resistance contact pair 74, a waveform Ip represents the rush current, and points a through d correspond to such damper positions of FIGS. 18(A) to 18(D).

Further, in the present embodiment shown in FIG. 13, there is provided an auxiliary contact block 91 including an auxiliary movable contactor 91a carrying an auxiliary movable contact, and an auxiliary stationary contactor 91b carrying an auxiliary stationary contact with respect to which the auxiliary movable contact is made to open and close in response to the opening and closing of the foregoing contact pairs 73 and 74. Opening and closing signals attained by this auxiliary contact block 91 are made to be inputs to a later described remote supervisory system.

Figure 14:
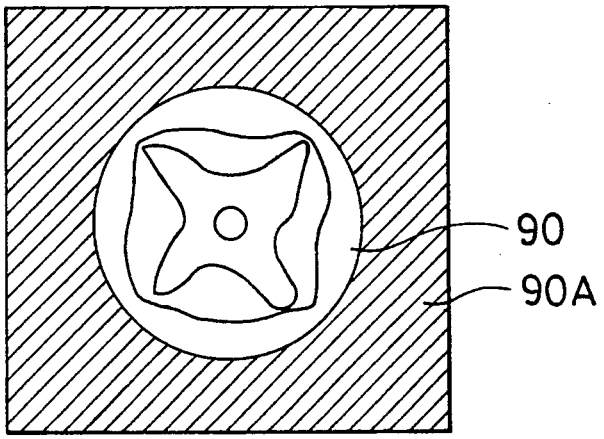
FIG. 14 shows in a plan view as magnified a damper employed in the relay of FIG. 11.
Figure 15:
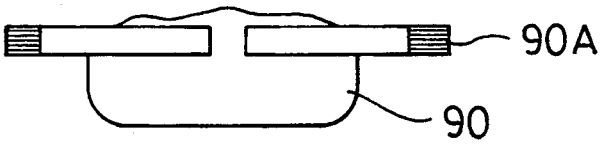
FIG. 15 is a sectioned view of the damper of FIG. 14.
Figure 16:
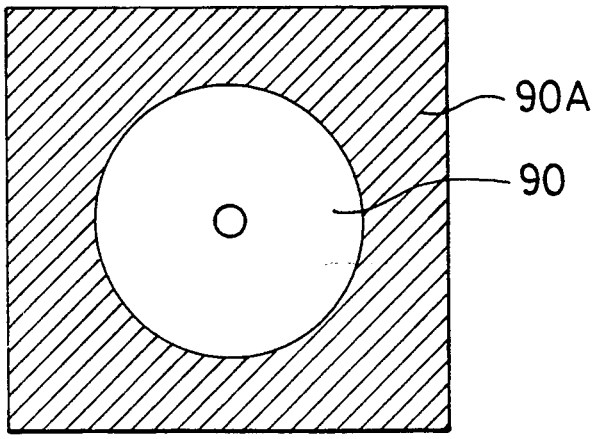
FIG. 16 is a bottom view of the damper of FIG. 14.
Figure 17:
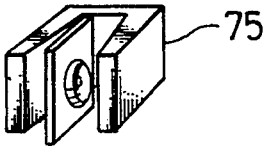
FIG. 17 is a perspective view of the damper in a mounted state of FIG. 14.
Figure 18:
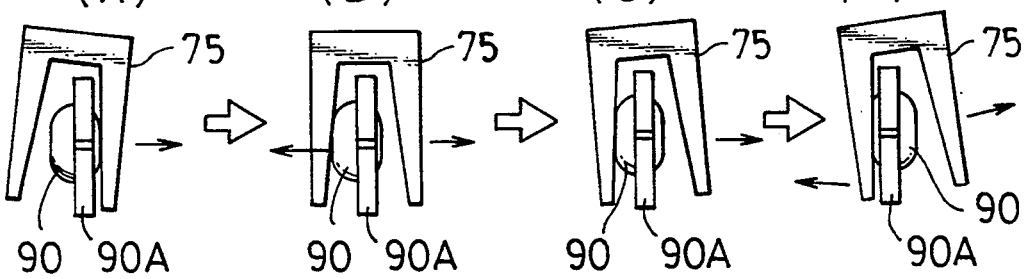
FIGS. 18(A) to 18(D) are explanatory views for the operation of the damper of FIG. 14.
Figure 20:
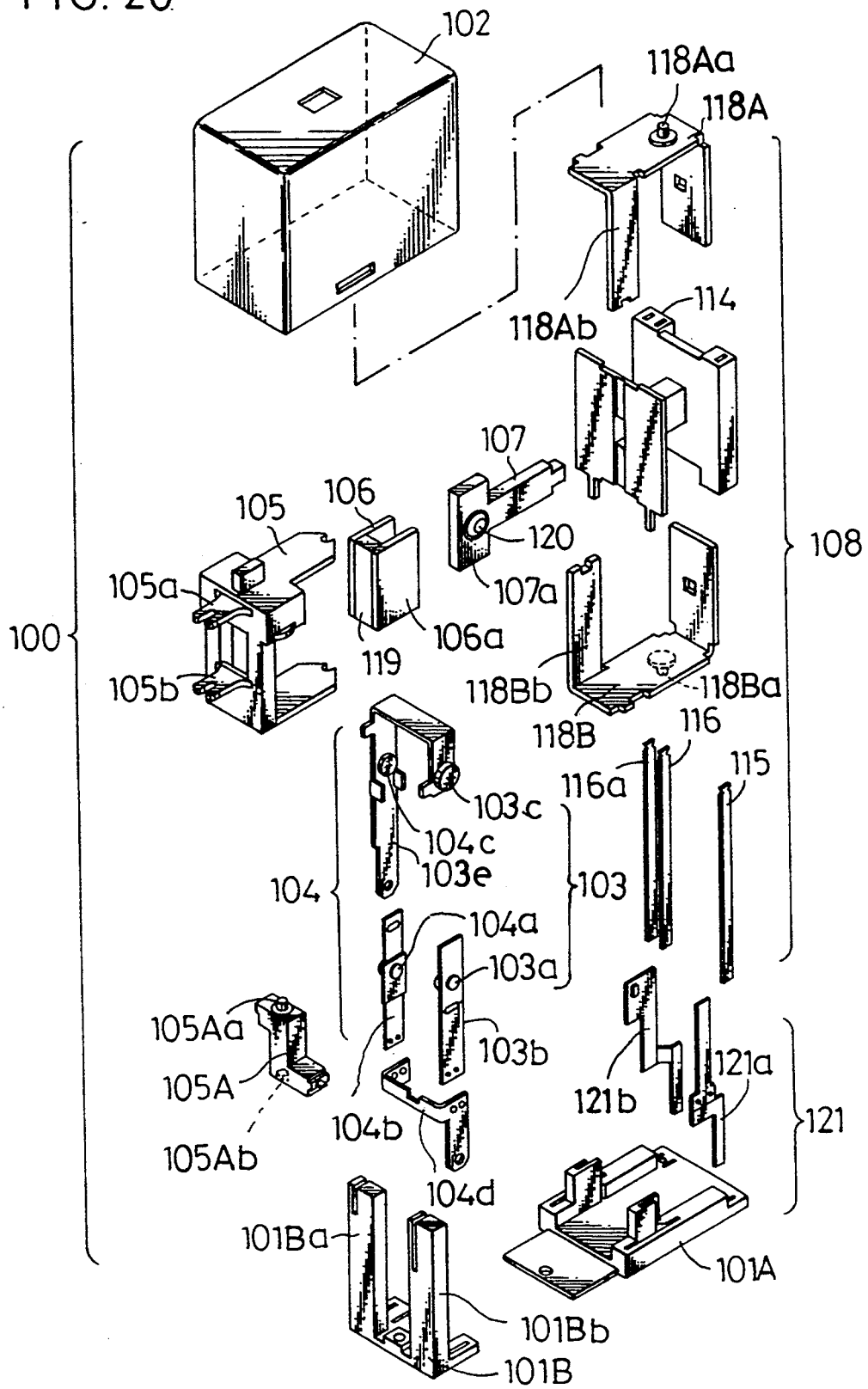
FIG. 20 shows in a perspective view as disassembled another embodiment of the electromagnetic relay according to the present invention.

In another embodiment of the present invention shown in FIG. 20, the supporting plate for the damper 120 is prepared not to be such separate member as shown in FIGS. 11 to 13 but to be as the magnetic pole part 107a of the stationary core plate 107, and the damper 120 is directly mounted to the pole part 107a substantially with the same arrangement as shown in FIGS. 14 to 16, whereby substantially the same function as in the embodiment of FIG. 11 to 13 can be attained.

Figure 22:
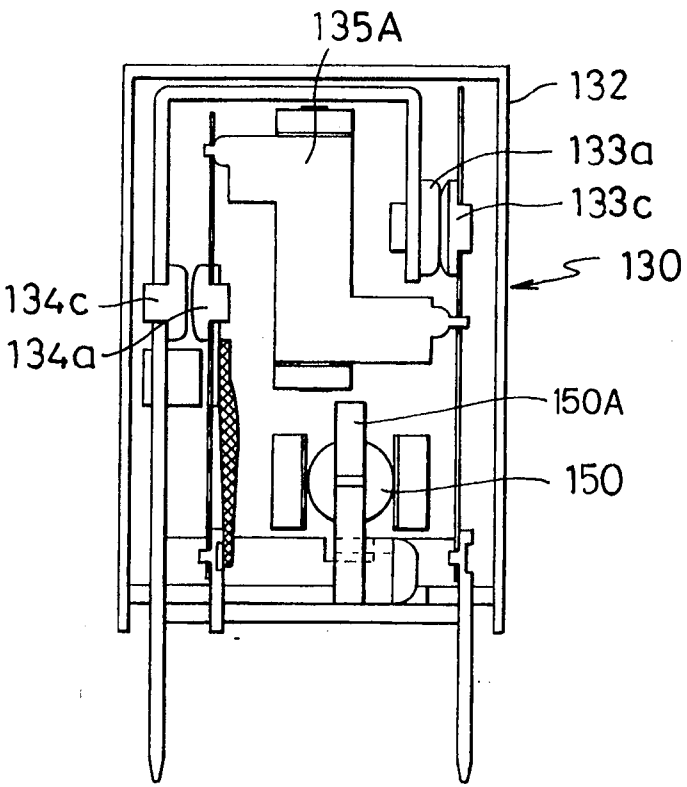
FIG. 22 is an interior side view of the relay shown in FIG. 21.
Figure 21:
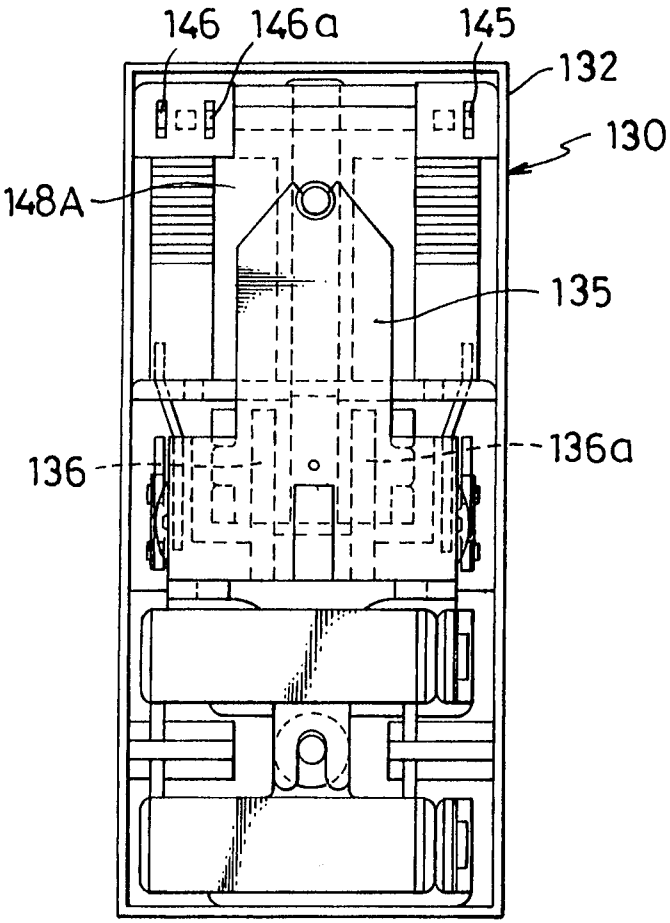
FIG. 21 shows in an interior plan view still another embodiment of the electromagnetic relay according to the present invention.
Figure 23:
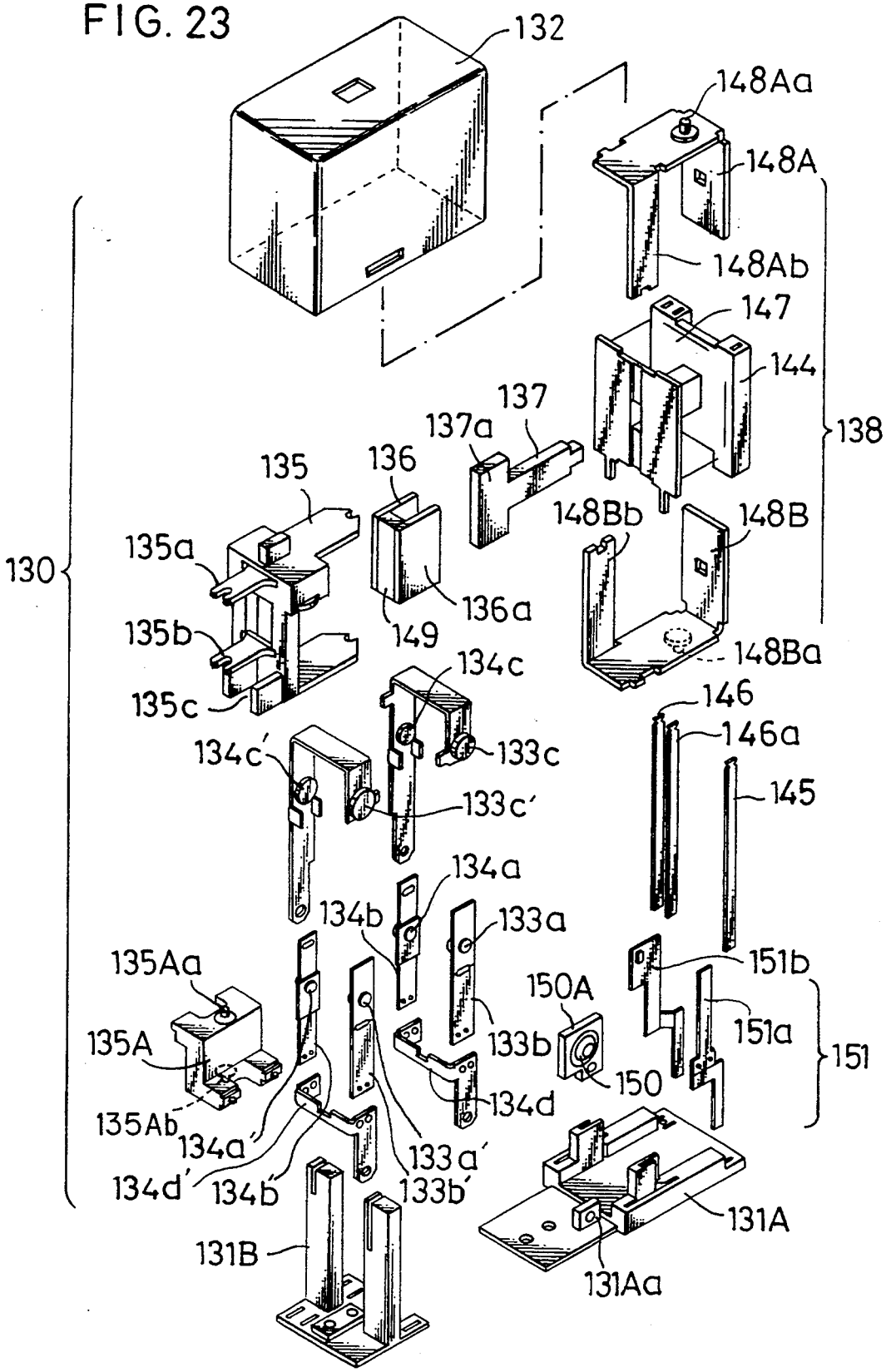
FIG. 23 is a perspective view as disassembled of the relay in the embodiment shown in FIG. 21.

In still another embodiment of the present invention as shown in FIGS. 21 to 23, there are provided two sets of the high fusion-bonding resistant and low contact-resistance contact pairs so that a so-called "2a" contact arrangement of a double break type can be obtained. Accordingly, the other actuator 135A coupled to the one actuator 135 is formed to be wide enough in the axial direction of the electromagnet means 138 for engaging across two sets of the movable contactors 133b, 134b and 133b', 134b' in the contact arrangement realizing "2a", to act concurrently on the movable contactors t33b, 133b' and 134b, 134b'. Now, in an event where, for example, either one of the two sets of contact pairs 133a, 133c and 133a', 133c' as well as 134a, 134c and 134a', 134c' involve a difference in the interval between the opposing contacts, one of the contact pairs will attain the closing operation prior to the other pairs, accompanying the rocking motion of the actuators 135 and 135A, and the actuators 135 and 135A further shifting in their rocking motion are subjected to a contact spring load of the contact pair already in closed state but not subjected to the contact spring load of the other contact pair not closed as yet. That is, in particular, the engaging part of the other actuator 135A with the movable contactor already in the contact closing state is to receive a relatively large contact spring load while the other engaging part with the other movable contactor of the contacts not closed as yet is to receive only a small amount of the contact spring load, so that the other actuator 135A is to be rotated about the one actuator 135 with the top and bottom pivot projections 135Aa of the actuator 135A with respect to the actuator 135 as the fulcrum so as to render the rorary moment to be equalized, whereby the spring loads given to both of the actuators 135 and 135a are made substantially uniform, and eventually the contact pressures given to the stationary contacts corresponding to both of the movable contactors can be substantially the same.

In the present embodiment, further, the damper 150 held by the support plate 150A is freely disposed between the horizontally opposing damper engaging projections 135c of the actuator 135. Further, it is also possible to employ the same auxiliary contact block 151 as that in the foregoing embodiment of FIG. 13.

Figure 24:
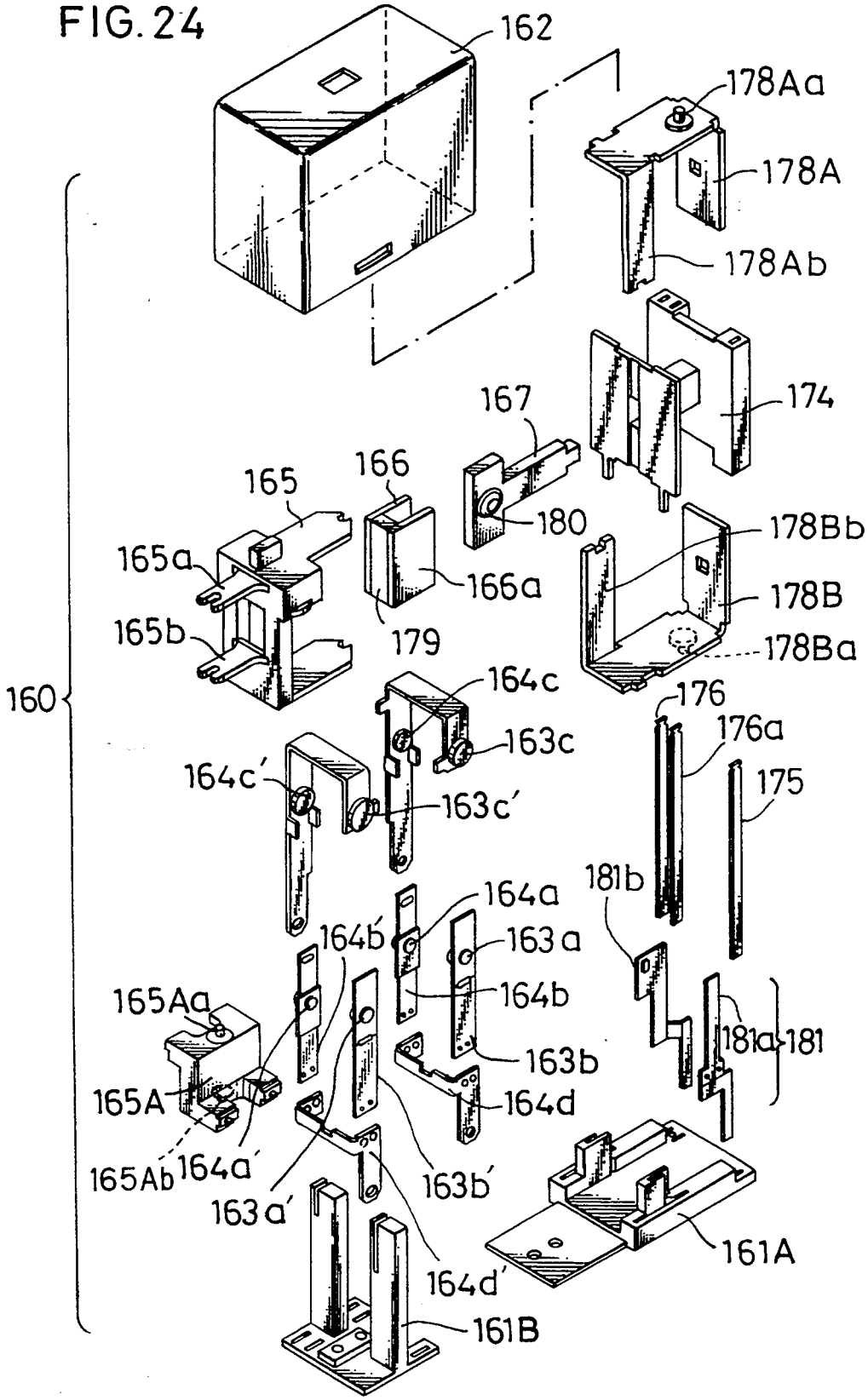
FIG. 24 shows in a perspective view as disassembled still another embodiment according to the present invention.

In a further embodiment shown in FIG. 24, the damper 180 is directly provided to the magnetic pole part of the stationary core 167 of the electromagnet means 168, in an electromagnetic relay having the "2a" contact arrangement.

In the respective embodiments shown in FIGS. 11–13, 20, 21–23 and 24, all other constituents and their functions are the same as those in the foregoing embodiment of FIGS. 1–3, and the same constituents as those shown in FIGS. 1–3 are denoted in the respective embodiments by the same reference numbers but with an addition of "60", "90", "120" or "150". In the embodiments in FIG. 20 and followings, too, the high fusion-bonding resistant contact pair, low contact-resistance contact pair, one actuator 105, 135 or 165, the other actuator 105A, 135A or 165A supported on the one actuator, and the auxiliary contact block 121, 151 or 181 are employed for the same purpose and in the same operation as those in the embodiment of FIGS. 11–13.

Figure 25:
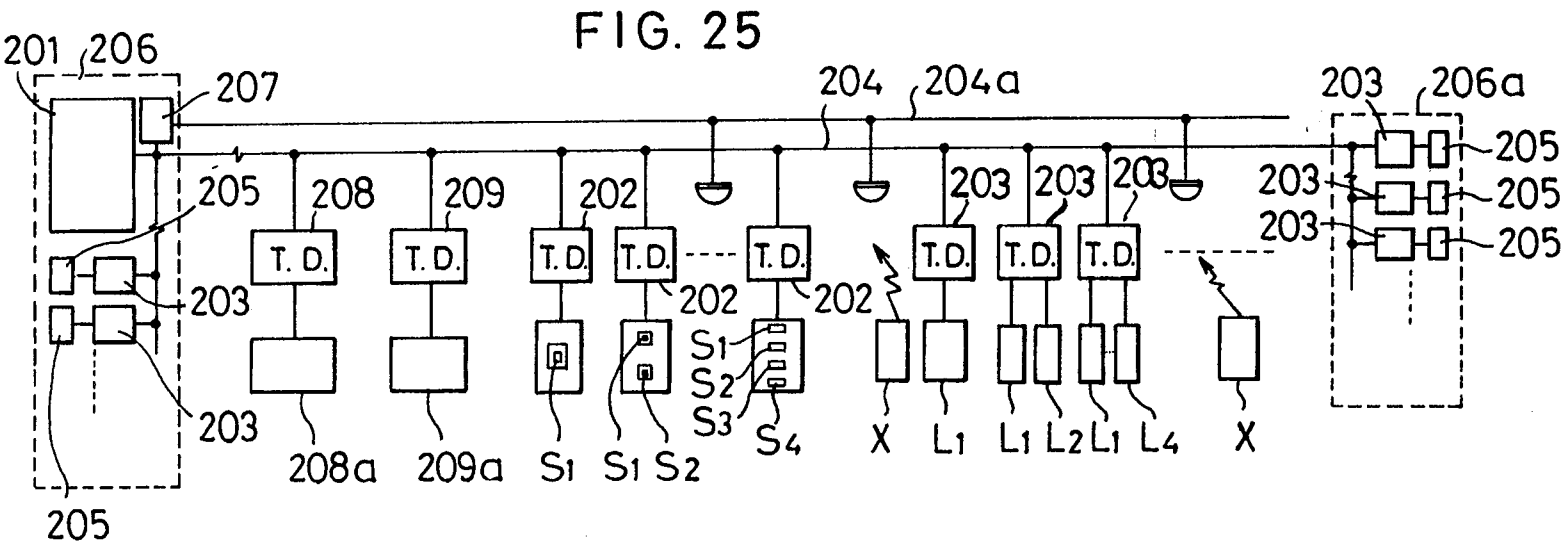
FIG. 25 is a schematic block diagram showing a remote control system in which the electromagnetic relay according to the present invention is employed.

Referring now to FIG. 25, there is shown a schematic arrangement of a remote supervisory system employing the foregoing electromagnetic relay of the present invention, in which a central control unit 201, a plurality of supervising terminal devices 202 respectively having a specific address set for supervising a plurality of switches S1 to S4, a plurality of controlling terminal devices 203 for controlling loads L1 to L4, a tandem terminal device 207 for wireless use, an external interface terminal device 208 and a selector switch terminal device 209 are connected to a pair of signal wires 204.

Figure 26:
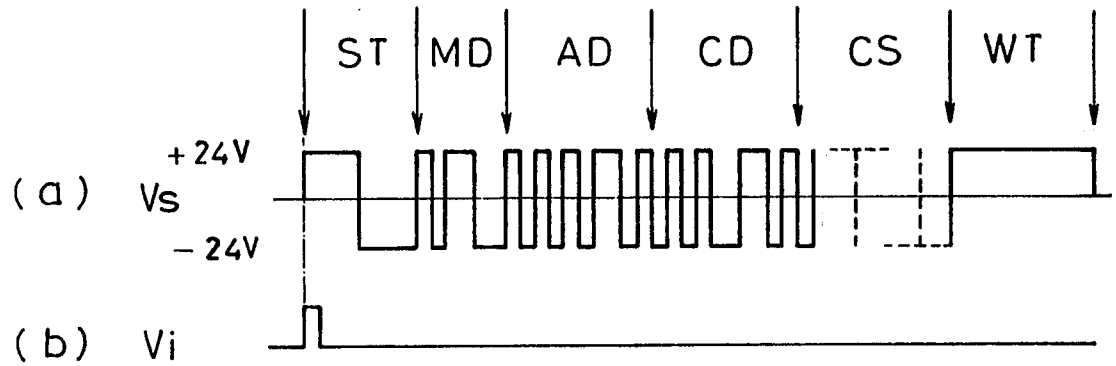
FIG. 26 shows in waveform diagrams the operation of the system of FIG. 25.

Here, a series of transmission signals Vs transmitted from the central control unit 201 to the signal wires 204 are bi-polar (+24 V) time-division multiple signals comprising, as shown in, for example, FIG. 26, a start pulse signal ST showing a transmission start of the signals, a mode data signal MD denoting the signal mode, an address data signal AD transmitting 8 bit address data for calling the terminal devices 202, 203 and 207–209, a control data signal CD transmitting control data for controlling the load L1 to L4, a check sum data signal CS and a return-wait signal WT for setting returning periods of the respective terminal devices 202, 203 and 207–209.

These terminal devices 202, 203 and 207–209 are respectively so arranged that the control data of the transmission signals Vs are taken up upon coincidence of the address of the transmission signals Vs received from the central control unit 201 through the signal lines 204 with the own address of each device, and supervisory data signals are returned to the central control unit. 201 as current mode signals in synchronism with the return wait signals WT in the transmission signals Vs.

Further, the central control unit 201 includes a dummy signal transmitting means which always transmitting a dummy transmission signal of the mode data signal MD made into a dummy mode, and an interruption processing means for processing an interruption signal Vi returned from any one of the supervisory terminals devices 202, tandem terminal devices 207, external interface terminal device 208 and selector switch terminal device 209 so as to access the particular terminal device which has transmitted the interruption signal to have the supervisory data returned from the particular terminal device.

Here, the external interface terminal device 208 is the one which carries out a data transmission between the same and an external control device 208*a*, and the selector switch terminal device 209 is the one which carries out the data transmission between the same and a data transmission terminal device 209*a* and which can perform a centralized control of many loads. Control outputs of the supervisory terminal devices 202 and controlling terminal devices 203 disposed in a distribution board 206 and relay control board 206*a* are to control remote-control relays 205 according to the present invention and provided on these boards 206 and 206*a* for controlling the loads. In addition, the wireless-use tandem terminal device 207 is to carry out a data relay in an optical wireless system comprising optical wireless oscillators X, optical wireless receivers Y and wireless-use signal lines 204*a*.

Figure 27:
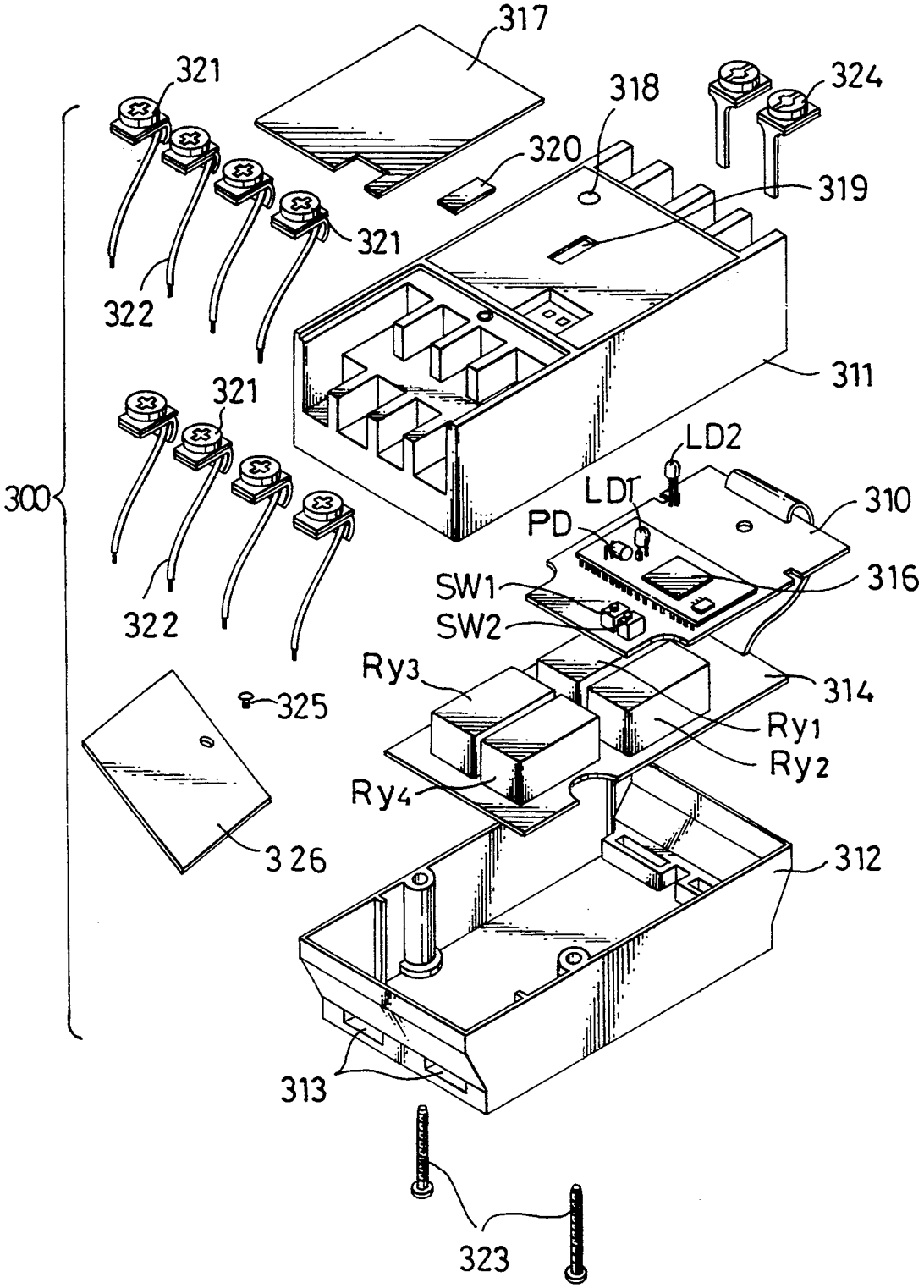
FIG. 27 shows in a perspective view as disassembled a terminal device employed in the system FIG. 25.

Next, a controlling terminal device 300 in which the relay according to the present invention is employed for the remote cotrolling as has been partly referred to in the above shall be explained with reference to FIG. 27. This controlling terminal device 300 generally comprises mutually fittable upper and lower housing members 311 and 312, remote-control relays Ry1–Ry4 mounted on a printed wiring board 314 disposed within the lower housing member 312, and a transmission module 310 mounted above these relays and including an address setter 316 formed by a processing circuit consisting of a microcomputer and EEP ROM or the like, photodiode PD, light emitting diodes LD1 and LD2 and the like, and general controlling switches SW1 and SW2 provided as required, the transmission module 310 being provided on a separate printed wiring board.

On one end side of the upper housing member 311, there are provided a number of connecting terminal screws 321 of any known arrangement, lead wires 322 are connected to these screws, and a cover plate 326 is fitted over the terminal screws and secured to the upper housing member 311 by means of a screw 325. On the other end side of the upper housing member 311, there are provided signal input terminal screws 324, and top face plate of the member 311 includes an elongated aperture 319 for passing therethrough light for transmission and reception of the photodiode PD as well as light from the light emitting diode LD1 on the transmission module 310, and a small aperture 318 for light from the light emitting diode LD2 also on the module 310 for allowing the signal reception to be confirmed. The aperture 319 is provided for fitting thereover a filter 320 for cutting infrared rays, and a name plate 317 is to be fitted on the top face plate of the member 311.

On the other hand, the lower housing member 312 is provided with mounting grooves 313 for easy mounting of the member to a mounting frame (not shown), and holes for passing screws 323 to fasten the member to the upper housing member 311.

Figure 28:
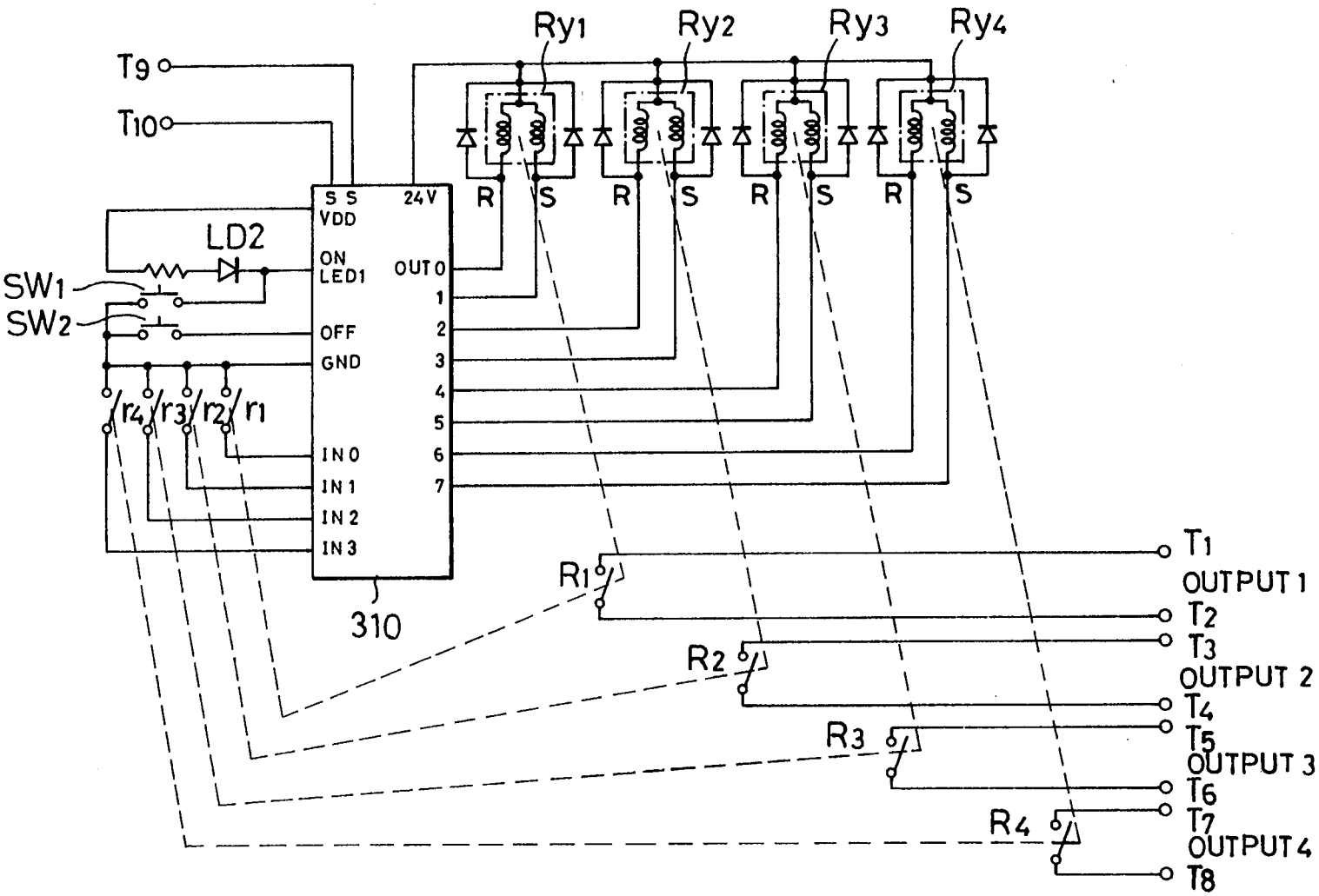
FIG. 28 shows a circuit diagram of the terminal device of FIG. 27.

Referring more specifically to the terminal device 300 with reference also to FIG. 28, the respective relays Ry1–Ry4 are connected to the high fusion-bonding resistant contact pairs and the low contact-resistance contact pairs R1–R4 mutually in parallel relationship and to the auxiliary contact blocks r1–r4, while the contact pairs R1–R4 are respectively connected to each of loads and the contact pairs r1–r4 are connected to the signal processing circuit of the transmission module 310. Thus, it will be appreciated that the loads connected to the respective relays are turned ON and OFF simultaneously with turning ON and OFF of the switches SW1 and SW2 for being subjected to smooth remote control. In FIG. 28, terminals T1 through T8 correspond to the connecting terminal screws 321, and terminals T9 and T10 correspond to the signal input terminal screws 324, so that the remote control signals can be properly provided to the transmission module 310.

What is claimed is:

1. An electromagnetic relay comprising:

an electromagnetic means having a magnetic pole part, an armature provided for engaging and disengaging motion with respect to said magnetic pole part, an actuator coupled to said armature and having pivot parts for a rocking motion together with said motion of the armature, a yoke provided with a magnetic pole means opposed to said magnetic pole part with said armature interposed between them, and with a first end opposing a rockable side end of said actuator and formed in a square shape as viewed in endwise direction, and a coil bobbin having an exciting coil wound thereon and a stationary core axially passed through said coil bobbin, said actuator including a pair of arms, each arm including one of said pivot parts, said arms extending in parallel to each other to dispose said pivot parts at symmetric positions, said yoke comprising two divided halves mutually coupled to provide a pair of arm parts extending in parallel to each other, a pair of supporting parts symmetrically positioned for pivotably supporting said pivot parts of the actuator, and a pair of connecting parts connecting across said arm parts on both sides thereof at said end to form said square shape, one of said pairs of said arm parts and connecting parts in said square shape acting as said magnetic pole means of the yoke, and said stationary core of said coil bobbin having a base end secured to said yoke at a second end of said yoke opposite the first end opposing the rockable side end of said actuator; and an opening end closing contact means including a high fusion-bonding resistant contact pair and a low contact-resistance contact pair, said high fusion-bonding resistant contact pair being provided in both lift-off and flexure types while said low contact-resistance contact pair being provided in a flexure type, and said contact pairs being disposed to mutually oppose with aid actuator of said electromagnet means interposed between them and respectively including a stationary contact and movable contactor carrying a movable contact for opening and closing operation with respect to said stationary contact;

wherein said movable contactors in both of said contact pairs are caused to rock through said actuator in response to said engaging and disengaging motion of said armature with respect to said magnetic pole part in said electromagnet means, and said high fusion-bonding resistant contact pair are closed prior to said low contact-resistance contact pair.

2. The relay according to claim 1, wherein said yoke comprises two divided halves each including each of said pair of parallel arm parts, at least one of said two divided halves having one of said pair of connecting parts.

3. The relay according to claim 1, wherein said yoke comprises two divided halves each including each of said pair of parallel arm parts, one of said pair of connecting parts being formed as an extended part of one of said two divided halves, while the other of said pair of connecting parts being a member separate from the two divided halves.

4. The relay according to claim 1, wherein said high fusion-bonding resistant contact pair and said low contact-resistance contact pair are provided in two sets in which the respective contact pairs are connected mutually in parallel relationship, and said actuator comprises first and second actuator members, said first actuator member being coupled to said armature, and said second actuator member being coupled through pivoting projections to said first actuator member for driving at least one of said contact pairs in said two sets of the high fusion-bonding resistant contact pairs and the low contact-resistance contact pairs at positions of equal distance with respect to said pivoting projections.

5. The relay according to claim 1, wherein said opening and closing contact means further includes a damper means for absorbing any shock of said engaging and disengaging motion of said armature with respect to said magnetic pole part of said electromagnet means.

6. The relay according to claim 5, wherein said damper means comprises a partition having a through hole, a compartment defined for deflation and inflation on both sides of said through hole of said partition, and an amount of fluid sealed in said compartment to be shiftable through said through hole of the partition for said deflation and inflation.

7. The relay according to claim 6, wherein said damper means is provided between said magnetic pole part of said stationary core and said pair of armatures secured to said actuator.

8. The relay according to claim 6, which said damper means is provided directly to said magnetic pole part of said stationary core.

9. An electromagnetic relay comprising:

an electromagnetic means including a magnetic pole part disposed stationary;

an armature provided for engaging and disengaging motion with respect to said magnetic pole part;

an actuator coupled to said armature and including a pair of arms, each arm including one of a pair of pivot parts, said arms extending in parallel to each other to dispose said pivot parts at symmetric positions for a rocking motion together with said motion of the armature;

a yoke provided with a magnetic pole means opposed to said magnetic pole part with said armature interposed between them, and with a first end opposing a rockable side end of said actuator and formed in a square shape in endwise view, said yoke comprising two divided halves mutually coupled to provide a pair of arm parts extending in parallel to each other, a pair of supporting parts symmetrically positioned for pivotably supporting said pivot parts of the actuator, and a pair of connecting parts connecting across said arm parts on both sides thereof at said end to form said square shape, one of said pairs of said arm parts and connecting parts in said square shape acting as said magnetic pole means of the yoke; and a coil bobbin having an exciting coil wound thereon and a stationary coil axially passed through said coil bobbin to be secured at one end to said yoke at a second end of said yoke opposite the first end of the yoke opposing the rockable side end of said actuator and secured at the other end to said magnetic pole part; and an opening and closing contact means including a high fusion-bonding resistant contact pair provided in both of lift-off and flexure types, a low contact-resistance contact pair provided in a flexure type, said contact pairs being disposed to mutually oppose with said actuator of said electromagnet means interposed between them and respectively including a stationary contact and a movable contactor carrying a movable contact for opening and closing operation with respect to said stationary contact, and an auxiliary contact block having contacts to be opened and closed in response to said opening and closing operation of said high fusion-bonding resistant and low contact-resistance contact pairs, for providing opening and closing signals to an associated means for remotely controlling the relay;

wherein said movable contactors in both of said contact pairs are caused to rock through said actuator in response to said engaging and disengaging motion of said armature with respect to said magnetic pole part in said electromagnet means, and said high fusion-bonding resistant contact pair are closed prior to said low contact-resistance contact pair.

* * * * *